United States Patent [19]

Okazaki et al.

[11] 4,327,713

[45] May 4, 1982

[54] MULTI THERAPEUTIC DEVICE FOR USE IN DYNAMIC THERAPY

[75] Inventors: Yasukichi Okazaki; Tatsuo Okazaki, both of Kamifukuoka, Japan

[73] Assignee: Kabushikigaisha Omco, Saitama, Japan

[21] Appl. No.: 188,951

[22] Filed: Sep. 19, 1980

[51] Int. Cl.[3] ..... A61H 1/00

[52] U.S. Cl. ..... 128/33; 128/32; 128/52; 128/64

[58] Field of Search ..... 128/36, 32, 33, 35, 128/37, 48, 49, 51, 52, 60; 74/49, 26, 810

[56] References Cited

U.S. PATENT DOCUMENTS

| | | | |
|---|---|---|---|
| 3,043,293 | 7/1962 | Rider | 128/52 X |
| 3,548,811 | 12/1970 | Wilson | 128/52 X |
| 3,800,785 | 4/1974 | Inada | 128/52 |
| 3,837,335 | 9/1974 | Teranishi | 128/52 |
| 4,041,938 | 8/1977 | Wintonin | 128/52 |
| 4,230,098 | 10/1980 | Vematsu | 128/33 |

*Primary Examiner*—Stephen C. Pellegrino
*Attorney, Agent, or Firm*—Frishauf, Holtz, Goodman & Woodward

[57] ABSTRACT

A multi therapeutic device for use in dynamic therapy comprises a reversible motor having an output shaft capable of being changed in two opposite revolving directions thereof; first and second one-way clutch means operable to the opposite revolving directions respectively so as to be alternatively connected with the output shaft; first and second eccentric rotor means driven by the motor power given via their one-way clutch means respectively; means for vibration driven by the first eccentric rotor means; means for taking out an orbital motion from the motion of the second eccentric rotor means; means for vertical dynamic motion including one or more reciprocating members with one or more dynamic therapy members; and means for changing the orbital motion to a suitable motion for use of and transmitting the motion to the vertical dynamic motion means.

17 Claims, 31 Drawing Figures

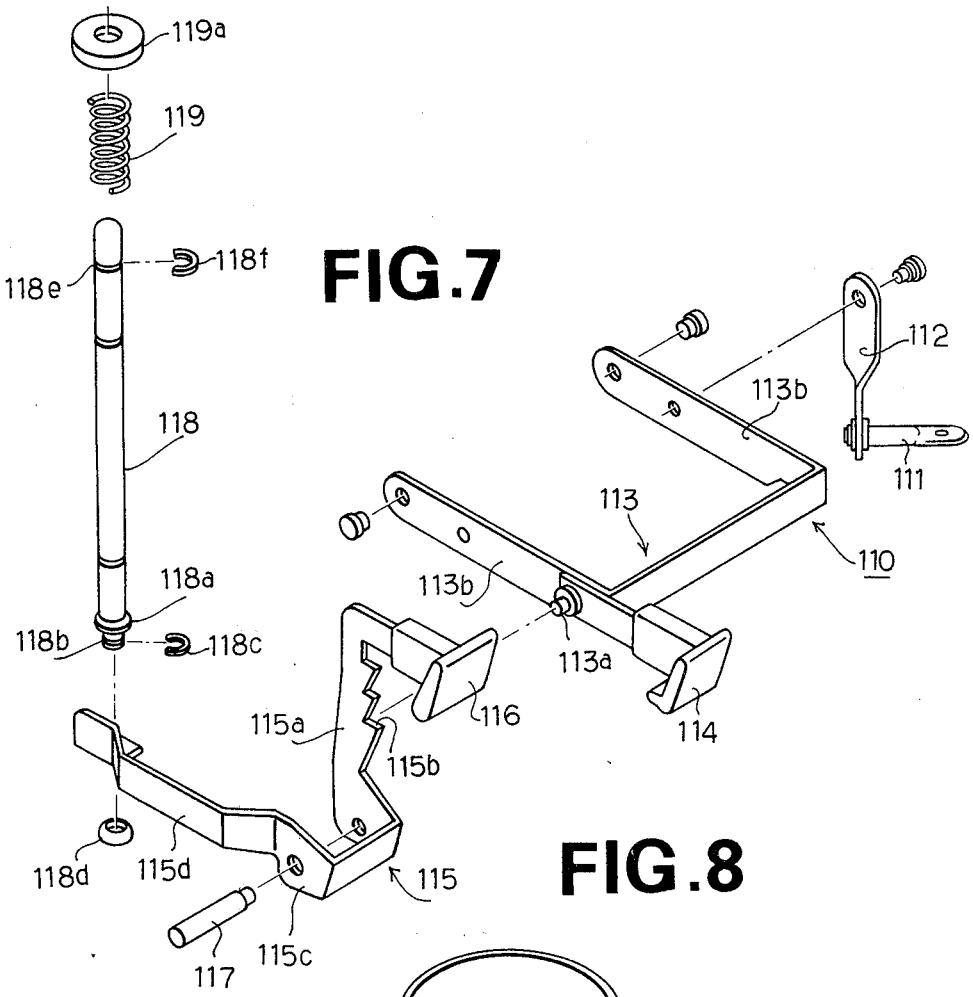
FIG.7
FIG.8
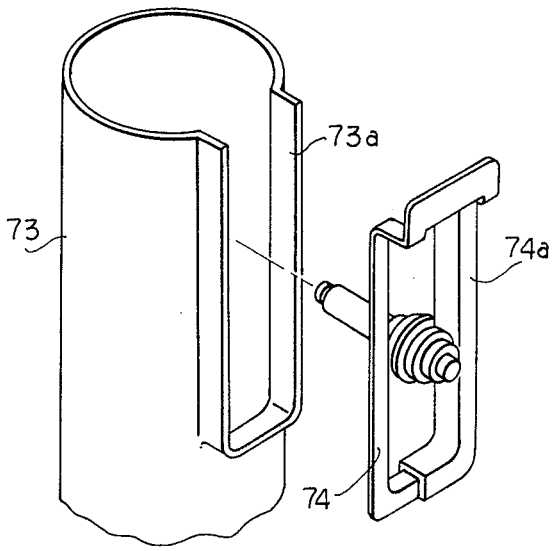

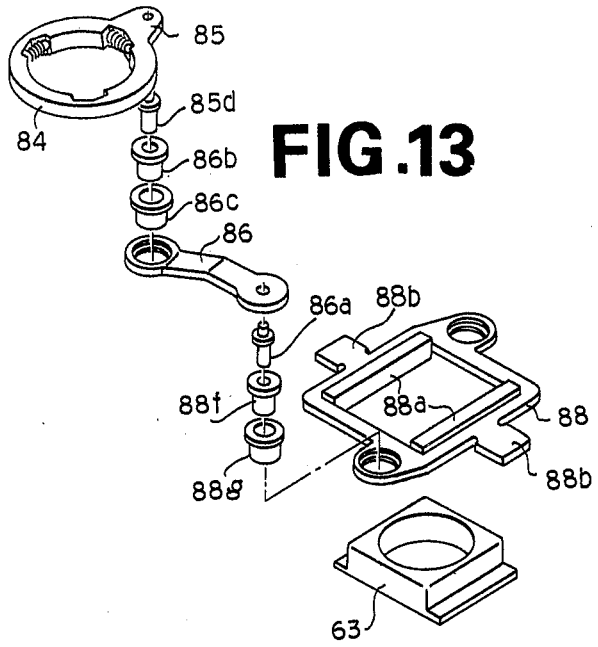
FIG.13
FIG.12
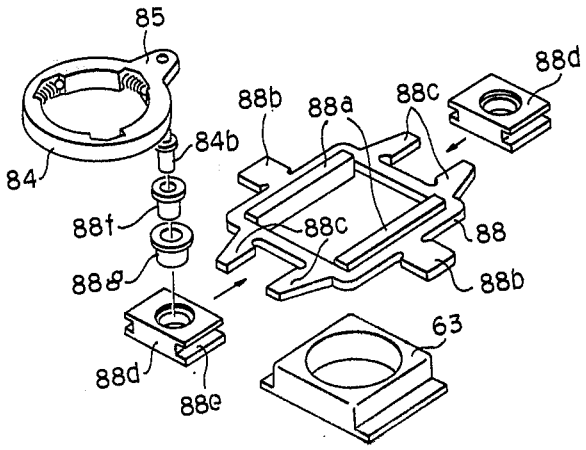

MULTI THERAPEUTIC DEVICE FOR USE IN DYNAMIC THERAPY

BACKGROUND OF THE INVENTION

This invention relates to a multi-therapeutic device for use in dynamic therapy and more particular to a multi-therapeutic device concurrently used to a massager with low-speed reciprocation such as kneading, finger-pressing and knocking, and a massager with high-speed vibration.

Generally, it had been understood that a vibration massager is originally constructed and never coupled to a massager with reciprocation such as kneading, finger-pressing and knocking. This is because, the former is a therapeutic device constructed for high-speed vibration, and the latter is a therapeutic device constructed for low-speed reciprocation so as to be placed to each other on different technical grounds, whereby it had been explained that their mutual combination is difficult.

Nevertheless, persons living in modern times have enough knowledge that their therapeutic devices cause different effects and should be preferably selected in accordance with person's conditions at each time. Accordingly, at the present time, it is awaited to make a multi-therapeutic device having a single construction or that with some attachments, capable of being used for various operations such as kneading, finger-pressing, knocking and vibration.

Important problems in order to make such multi-therapeutic device are, the present inventors think, to involve power transmission from a single power source to suitable means for various therapeutic operations, not to interfere between a selected means for therapy and the other means for different therapy, and to have a simple mechanism organized with concurrent use of parts as many as possible.

An object of this invention is to provide an improved therapeutic device for use of various dynamic therapy including a simple mechanism which is made so as not to interfere between means for various therapy and has many common parts.

Another object of this invention is to provide an improved therapeutic device for use of various dynamic therapy involving a low-speed reciprocation mechanism having bias means, thereby to slowly charge and intermittently discharge large power in spite of use of a small motor.

The third object of this invention is to provide an improved therapeutic device for use of various dynamic therapy involving a low-speed reciprocation mechanism having a simple and speed-decreasing means, thereby to charge and discharge large power for therapy in spite of use of a small motor.

The other objects and features of this invention will be apparently described with reference to the accompanying drawings.

BRIEF DESCRIPTION OF THE DRAWINGS

FIG. 7 is a perspective view of means for releasing and adjusting bias applied to the low-speed action involved in the device of FIG. 1, as illustrated in pieces;

FIG. 8 is a perspective view of parts of the low-speed action mechanism involved in the device of FIG. 1, as illustrated in pieces;

FIG. 12 is a perspective view of means for reciprocation involved in the fourth embodiment of this invention, as illustrated in pieces;

FIG. 13 is a perspective view of the means modified from that of FIG. 12, as illustrated in pieces;

DETAILED DESCRIPTION

Figure 1:
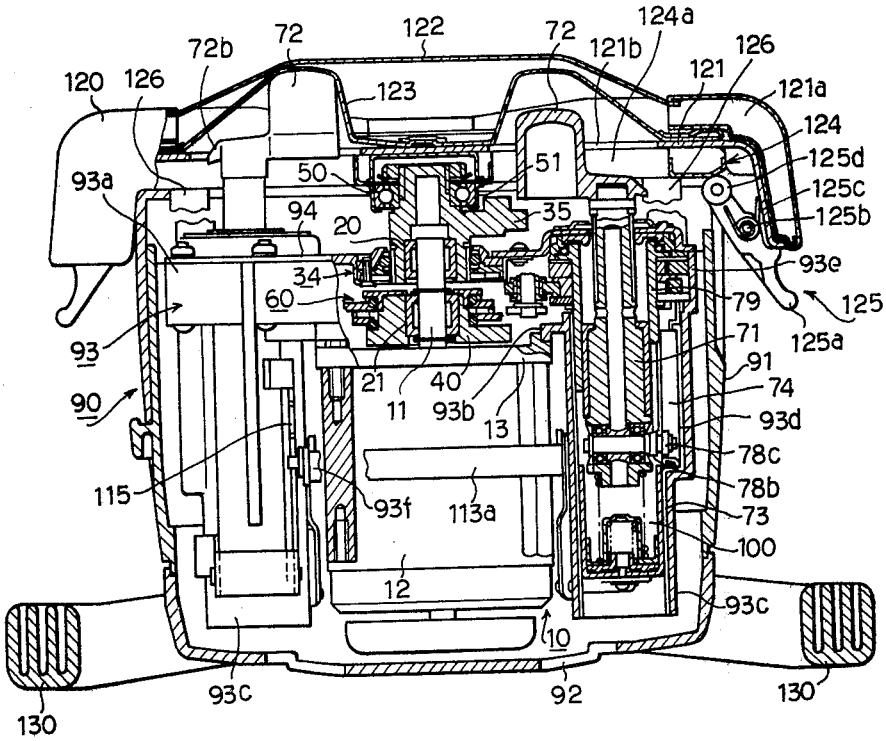
FIG. 1 is a cross-sectional front elevation of a multi-therapeutic device embodying this invention.

Referring to the drawings, there are provided a multi-therapeutic device for use in dynamic therapy generally called as "massager". The multi-therapeutic device comprises a reversible electric motor 10 having an output shaft 11 capable of being changed in two opposite revolving directions thereof; first and second one-way clutch means 20 and 21 operable to the opposite revolving directions respectively so as to be alternatively connected with the output shaft 11; first and second eccentric rotor means 30 and 40 driven by the motor power given via their one-way clutch means 20 and 21 respectively; means 50 for vibration driven by the first eccentric rotor means 30; means 60 for taking out an orbital motion from the motion of the second eccentric rotor means 40; means 70 for vertical dynamic motion including one or more reciprocating members 71 though this embodiment includes two reciprocating members, they may be any numbers, with one or more dynamic therapy members 72 corresponding to the reciprocating members 71; and means 80 for changing the orbital motion to suitable motion for use of and transmitting the motion to the vertical dynamic motion means 70.

The multi-therapeutic device further includes a housing 90 for containing the means mentioned above. The housing 90 comprises an outer frame 91 having a rectangle section, a bottom frame 92 formed into a disc-shape and detouchably attached to the bottom end of the outer frame 91, and an inner frame 93 integrally formed to the inner portion of the outer frame 91. The inner frame 93 comprises a rectangular portion **93*a* having a through bore 93*b* formed at the center portion thereof, two cylindrical supporting portions 93*c* having elongated stages 93*d* respectively formed at the sides of the supporting portions 93*c*, and receivers 93*e* formed to the both ends of the portion 93*a* above the supporting portions 93*c* respectively. The housing 90 further comprises a cover member 94 formed into a rectangular plate and having a center bore 94*a* in corresponding to the center bore 93*b* and cap-shaped portions 94*b* with through bores 94*c* in corresponding to the supporting portions 93*c* respectively. The cover member 94 is disposed on the inner frame 93. The motor 10 includes a motor body 12 having a square flange 13 fixed to the inner frame 93 by means of bolt-nut. The shaft 11 comprises a first portion 11*a*, a second portion 11*b*, and circular clip-insert grooves 11*c* and 11*d* formed to the periphery thereof. Clips 14 formed in C-shape are inserted into the grooves 11*c* and 11*d* to maintain the one-way clutch means 21 between them via annular oil-less metals 15**.

The one-way clutch means 20 is fitted to the second portion **11*b* of the shaft 11, and connected to the first eccentric rotor means 30. The first eccentric rotor means 30 includes a rotor member 31 with a supporting bore 32, in which the one-way clutch means 20 is fixedly inserted, a peripheral metal 33 rotatably supported to a bearing 34, an eccentric balance weight 35 integrally formed to the rotor member 31, an eccentric periphery 36, the axis of which is not accord to the axis of the supporting bore 32, i.e., the bearing 34 due to a suitable slight eccentric distance, thereby to vibratingly rotate the eccentric periphery, and a screw 37 threaded to the top of the rotor member 31. The bearing 34 includes a bearing chock 34*a* formed into a cap-shape, an upper race 34*b*, a lower race 34*c*, a plenty of bearing balls 34*d* disposed between the races 34*b* and 34*c* in a manner to be rotatably contact with the pheriphery of the metal 33, and a supporter ring 34*e* for supporting the balls 34*d* mutually separated. The bearing chock 34*a* together with the races 34*b* and 34*c* is fixed to the cover member 94 by means of bot-nut. The bearing 34 specially includes a one-way clutch means 37 comprising a stational ring body 37*a* with one or more receiving grooves 37*b* opening at the inner periphery of the body 37*b* respectively, one or more roller pieces 37*c* placed in the grooves 37*b* respectively, and means for biasing the roller pieces 37*c* toward the periphery of the metal 33 through the openings of the grooves 37*b*, such as spring steel plates 37*e* having zigzag-shape, whereby the rotor member 31 is prevented from the reverse rotation when the one-way clutch means 20 is released to the output shaft 11**.

The means 50 for vibration is as a ball bearing in this embodiment, the outer race of which is stationally supported to a cap shaped bearing chock 51, and the inner race of which is fixed to the eccentric periphery 36 by means of a nut 38 fitted to the screw 37.

The second eccentric rotor means 40 is as a rotor block in this embodiment, the rotor block 40 including a supporting bore 41, in which the one-way clutch means 21 is fixedly inserted, a disc flange 42 formed at the lower portion of the rotor block 40, an eccentric periphery 43, the axis of which is not accord to the axis of the supporting bore 41, i.e., the shaft 11 due to a suitable eccentric distance, thereby to take out an orbital motion.

The means 60 for taking out the orbital motion includes a plenty of bearing balls 61 surrounding the eccentric periphery 43 in a manner to be disposed on the flange 42, a supporter ring 62 for supporting the balls 61 mutually separated, a pair of orbital motion members 63 rotatably fitted with the eccentric periphery 43, one of which is disposed on the balls 61, a plenty of rollers 64 supported to a supporter ring 65, via which the orbital motion members 63 are placed with one over the other, a plenty of bearing balls 66 surrounding the eccentric periphery 43 in a manner to be disposed on the upper orbital motion member 63, a supporter ring 67 for supporting the balls 66 mutually separated, and a fixing plate 68 attached to the upper end of the rotor block 40 in a manner to act as a bearing race carrying the balls 66.

The vertical dynamic motion means 70 includes a hollow cylindrical container sleeve 73 inserted in the cap-shaped portion **93*c*. The container sleeve 73 involves a side opening 73*a* with a vertical longitudinal slit guide 74 covered by means of resinous layer 74*a* so that the slit guide 74 is disposed in the stage 93*d***.

The vertical dynamic motion means 70 further includes a cap-shaped guide 75 fixed to the inner portion of the cap **94*b* through an annular cushion 76 and having a protrusion 75*a* formed to the side of the guide 75, the protrusion 75*a* being placed in the receiver 93*e*, and an annular cushion 77 for preventing the traverse motion of the reciprocating member 71, the cushion 77 being attached to the upper portion of the cap-shaped portion 94*b* and fixed thereto by means of an annular supporter 77*a*, which is secured to the cap-shaped portion 94*b* by means of pins 94*d* formed thereon. Accordingly, the reciprocating member 71 protrudes through a bore 75***b* formed at the center portion of the guide 75, and through the bore 94*c*, above the frame 94.

The reciprocating member 71 involves a rod portion 71*a* with a hollow cylinder 71*b* fitted to the rod portion 71*a* and a supporting portion 71*c* with a hollow cylinder 71*d* fitted to the supporting portion 71*c*.

The vertical dynamic motion means 70 further includes a cam follow shaft 78 which is journalled to the reciprocating member 71 by means of bearings 78*a*, a cam follow 78*b* having a conical peripheral surface and attached to the cam follow shaft 78, a guide roller 78*c* attached to the end of the cam follow shaft 78 so as to be rotatably guided along the slit guide 74, and air path 78*d* formed through the supporting portion 71*c*, one end of which is opened at the base position of the rod portion 71*a* and the other end of which is opened at the bottom position of the supporting portion 71*c*. The supporting portion 71*c* is slidably inserted into a hollow cylindrical cam member 79 turnably supported in the container sleeve 73. The cam member 79 includes a spiral cam surface 79*a* formed on its end periphery and a stepped portion 79*b* (one exists in this embodiment) formed on the end pheriphery in a manner to form the bottom end of the cam member 79 into a saw tooth. The cam follow 78*b* turns along the cam surface 79*a* as the cam member 79 is rotated. The cam member 79 has an annular flange 79*c* formed to the upper portion of its periphery and includes a plenty of bearing balls 79*d* disposed on the flange 79*c* so that the balls 79*d* is rotatably inserted into the interior of the guide 75. The cam member 79 further has a clip groove 79*e* formed to the periphery. A clip 79*f* is set in the groove 79*e*. The dynamic therapy member 72 is secured to the top portion of the reciprocating member 71 by means of a cross-pin 72*a*, and has a hook portion 72*b* for connecting the vertical dynamic motion means 70 to an attachment for kneading to be described after.

The changing means 80 includes two race plates 81 with protrusions 81*a* respectively, the race plates 81 being fitted to the periphery of the cam member 79 in such a manner that the upper race plate is adjacent to the annular flange 79*c* and the lower race plate is adjacent to the clip 79*f* with their protrusions 81*a* being placed in the receiver 93*e* for preventing the race plates 81 from revolution. The changing means 80 further includes a reverse preventing clutch 82 having an annular clutch plate 82*a* with a protrusion 82*b*, roller holding grooves 82*c* formed to the inner periphery of the clutch plate 82*a*, rollers 82*d* placed in the grooves 82*c* respectively in a manner to face the periphery of the cam member 79, and means of S-shaped compression springs 82*e* to push the roller out of the groove 82*c*; and an one-way clutch 83 comprising an annular clutch member 83*a* having three tapered roll guides 83*b* formed to the inner periphery thereof, an annular race 83*c* fitted to the interior of the clutch member 83*a* and having three holding grooves 83*d*, three rollers 83*e* placed in the grooves 83*d* respectively in a manner to be carried between the roller guide 83*b* and the periphery of the cam member 79, and means of S-shaped compression springs 83*f* to urge the rollers 83*e* respectively. The reverse preventing clutch 82 and the one-way clutch 83 are positioned between the race plates 81.

The changing means 80 involves one or more crank motion elements 84 driven by the orbital motion, and one or more turning elements 85 reciprocatingly driven by the crank elements 84. In this first embodiment, the crank motion element 84 is indicated as a crank arm formed to the side of the orbital motion member 63, and the turning element 85 is indicated as a turning arm formed to the side of the clutch member 83*a*. The crank arm 84 and the turning arm 85 are mutually pivoted by means of a pivot pin 84*a* secured to the free end of the crank arm 84 and a hollow sleeve 85*a* attached to the free end of the turning arm 85 via a rubber cushion ring 85*b*, the pivot pin 84*a* being rotatably inserted to the sleeve 85*a*.

In this first embodiment, the vertical dynamic motion means further includes bias means 100 to which the power is charged by one-direction movement of the reciprocating member 71. Means for discharging the biassed power for a time so as to move the reciprocating member 71 in an opposite direction consists of a combination of the cam follow 78*b*, cam surface 79*a* and stepped portion 79*b* already mentioned. The bias means 100 comprises a first coiled compression spring 101 for biassing the reciprocating member 71, a first supporter 102 for supporting the spring 101, a second coiled compression spring 103 for biassing the supporter 102 toward the spring 101, and a second supporter 104 for supporting the spring 103. The number 105 indicates a hollow cylinder for containing the springs 101 and 103 together with the supporters 102 and 104.

Further, the multi-therapeutic device includes means 110 concurrently used for releasing the bias means 100 from the reciprocating motion of the reciprocating member 71, and for adjusting the power which is charged to the bias means 100.

The means 110 for releasing and adjusting bias comprises an operation member 111 attached to the bottom of the second supporter 104 together with the cylinder 105, a link rod 112 pivoted to the member 111 at its lower end, a lock arm member 113 made of an elongated plate bent to U-shape, the lock arm member 113 having a hook portion 113*a* and two side arms 113*b* pivoting the upper end of the link rod 112 at the middle portion and pivoted to two blackets 93*f* formed to the opposite sides of the cylindrical supporting portions 93*c*, and an operation lever 114.

The means 110 further includes a selector 115 having an engaging plate 115*a* with a plurality of stepped portions 115*b* formed into saw-teeth shape, the plate 115*a* being vertically elongated, a pivot portion 115*c* formed to the lower end of the engaging plate 115*a*, and a swing lever 115*d* horizontally elongated from the pivot portion 115*c*; a push button 116 attached to the upper end of the engaging plate 115*a*; and a pivot pin 117 by which the pivot portion 115*c* is swingably journalled to the sides of one of the cylindrical supporting portions 93*c*. And then, the hook portion 113*a* is selectively engageable with one of the stepped portions 115*b* by simultaneous operation of the operation lever 114 and the push button 116.

The means 110 still further includes a releasing rod 118, the lower end of which is loosely engaged with the free end of the swing lever 115*d* by means of a stop flange 118*a*, an annular clip groove 118*b*, a clip 118*c* and a nut 118*d*, they being positioned to the lower portion of the releasing rod 118, and a coiled compression spring 119 for biassing the releasing rod 118 upwards, the spring 119 loosely surrouding the rod 118 in such manner that the upper end of the rod 118 by means of an annular clip groove 118*e* formed to the rod 118 and a clip 118*f*, and the lower end of the rod 118 is supported to the upper portion of the cover member 94 under the condition that the rod 118 is slidably inserted to an longitudinal through bore 93*g* formed to the side of one of the cylindrical supporting portion 93*c*.

In the multi-therapeutic device is provided a therapeutic head member 120 having a rectangular plate frame 121 with a cushion pad 121*a* and a pair of through bores 121*b;* a flexible touching sheet 122 spreaded on the upper portion of the head member 120 so as to cover the bores 121*b;* an elastic belt 123 disposed inside of the touching sheet 122 with it stretching amoung both ends and center portion of the frame 121 to over the bores 121*b;* and to the back of which the therapy members 72 are capable of being depressed; an installing base member 124 with through bores 124*a* corresponding to the bores 121*b,* and to which the head member 120 is detouchably connected by means of clamper 125; and four flexible supporters 126 each formed to column-shape and having bolts 127*a* the heads of which are embedded in the ends of supporters 126, the bolts causing to connect the supporter to the base member 124 and the cover member 94, whereby the base member 124 is supported to the cover member 94 so as to be capable of being vibrated. To the center portion of the base member 124 is fixed the bearing chock 51 mentioned above. The clamper 124 includes a clamp lever 125*a* pivoted to the inside end of the head member 120 by means of a pin 125*b* and urged to one turning direction, as shown in FIG. 1 by an arrow line, by means of a coiled torsonal spring 125*c* surrounding the pin 125*b,* and a clamp roller 125*d* pivoted to the clamping end of the clamp lever 125*a.*

Figure 2:
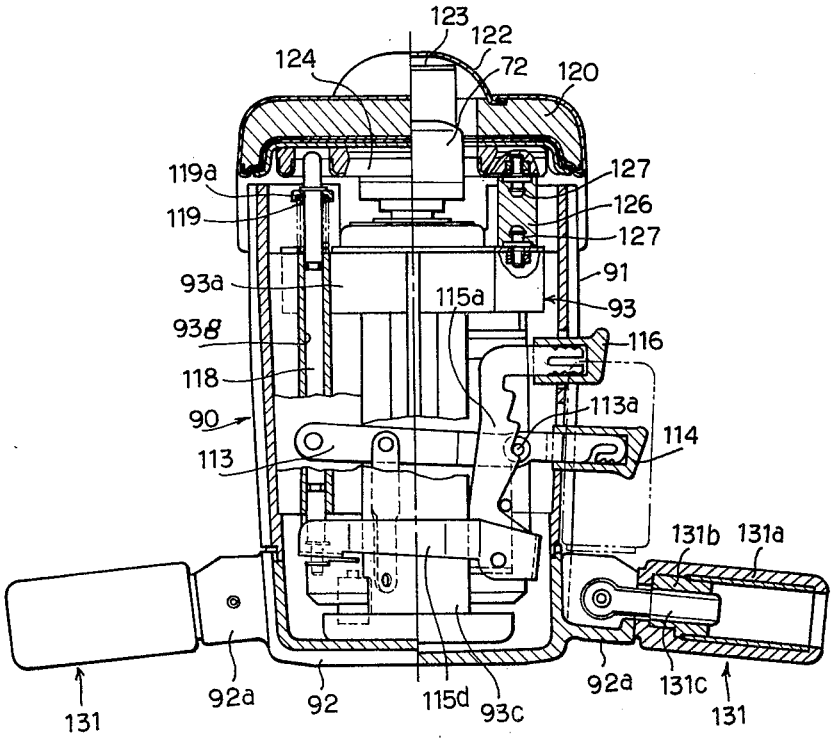
FIG. 2 is a cross-sectional side elevation of the device illustrated in FIG. 1.
Figure 3:
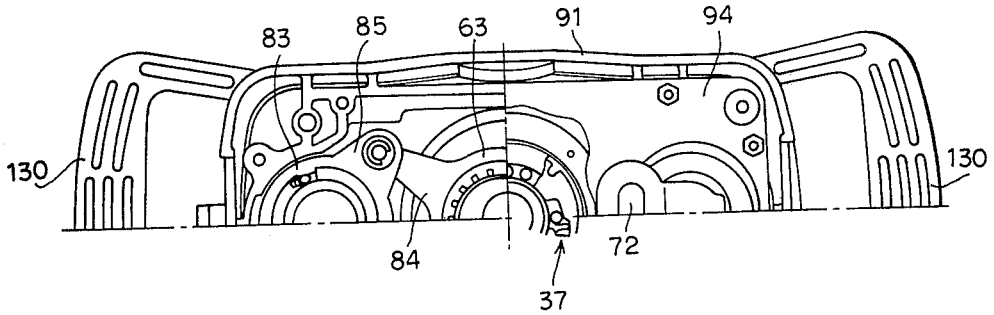
FIG. 3 is a cross-sectional plane of the device illustrated in FIG. 1.
Figure 4:
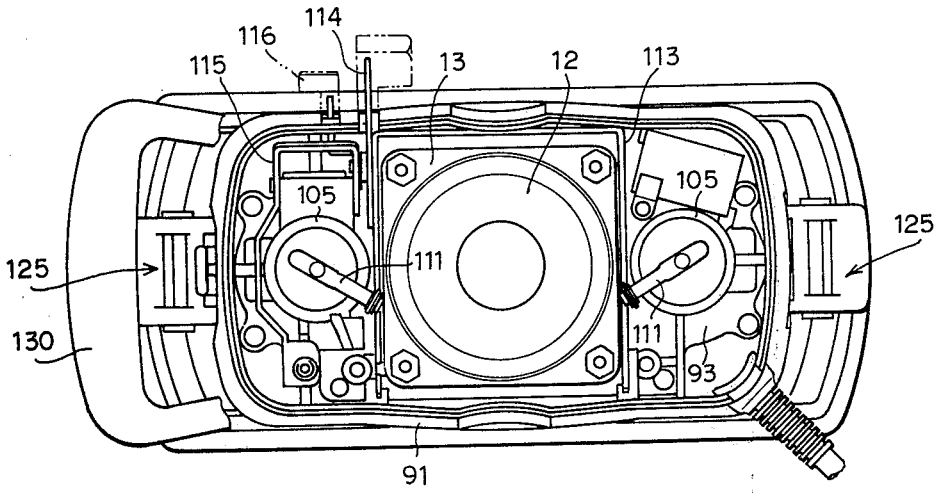
FIG. 4 is a cross-sectional bottom of the device illustrated in FIG. 1.
Figure 5:
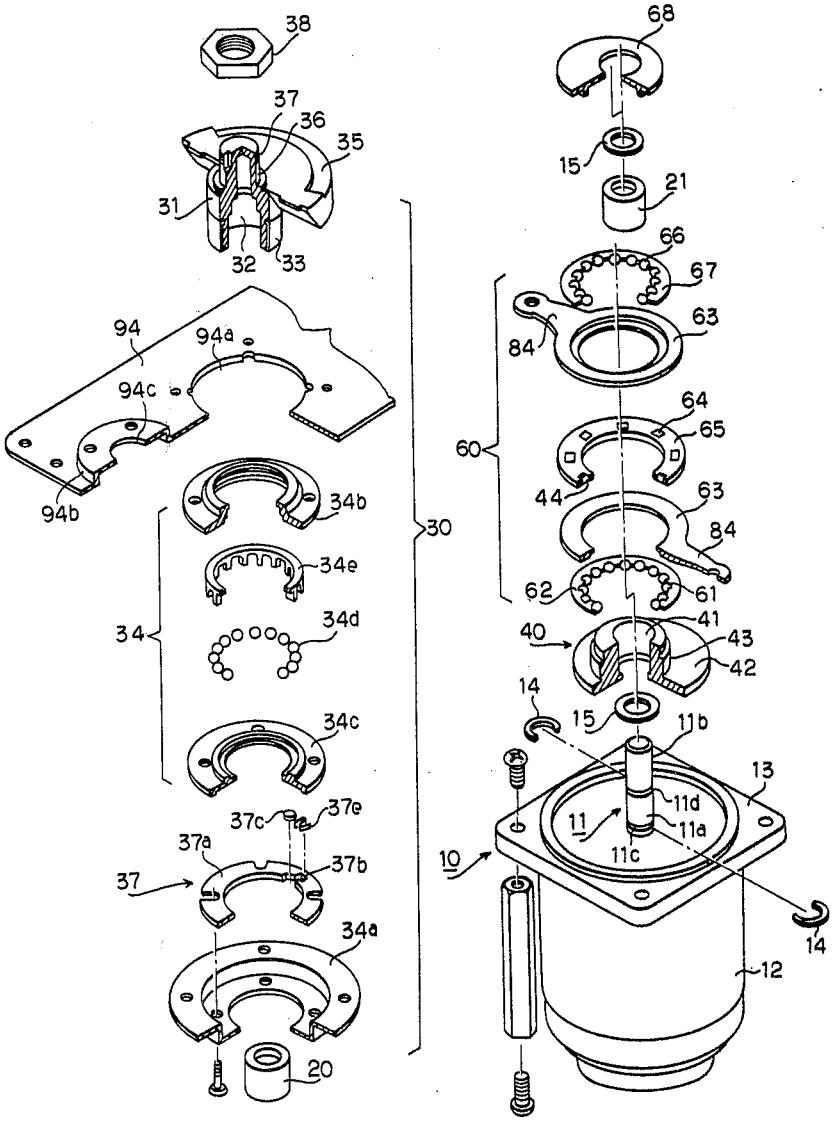
FIG. 5 is a perspective view of means for transmission involved in the device of FIG. 1, as illustrated in pieces.

Further, this first embodiment includes a pair of stational loop handles 130 formed to both ends of the bottom frame 92, and may be preferably provided with a pair of foldable grip handles 131 pivoted to the both sides of the bottom frame 92. Each of the grip handles 131 includes a hollow cylindrical grip member 131*a* having an internal threaded screw piece 131*b* attached to the inner perphery thereof; and a screw rod 131*c* pivoted to a bracket 92*a* formed to the side of the bottom frame 92 and engaged with the screw piece 131*b,* thereby to be folded as the screw is loosen, as shown in FIG. 2 by a chain line.

In the embodiment, the first one-way clutch 20 is on marketing and available to act in a rotation direction, and the second one-way clutch 21 also is on marketing and available to act in an opposite rotation direction against that in which the first one-way clutch 20 acts.

The operation of the multi-therapeutic device of this invention is as follows:

In order to operate the device for vibrating massage, the electric motor 10 is driven in a prescribed rotating direction so that the one-way clutch 20 is engaged with the output shaft 11 and the one-way clutch 21 is released to the output shaft 11, whereby the rotor member 31 is rotated to transmit the orbital motion due to the eccentric periphery 36 to the bearing 50, and then the installing base member 24 is vibrated on a horizontal plane with the bearing chock 51. Accordingly, the therapeutic head member 120 is vibrated together with the installing base member 124 due to connection by means of the clamper 125.

In order to operate the device for knocking massage, the electric motor 10 is driven in a reverse rotating direction so that the one-way clutch 20 is released to the output shaft 11 and the one-way clutch 21 is engaged with the output shaft 11, whereby the rotor block 40 is rotated to transmit the orbital motion due to the eccentric periphery 43 to the both orbital motion members 63 and then the crank motion elements 84 are reciprocatingly rotated, because that the elements 84 are pivoted to the turning arms 85 and the clutch member 83*a* is capable of being reciprocatingly rotated. In this case, the one-way clutch means 37 acts to be engaged with the rotor member 31 so as to set the rotor member 31 in a rigid position.

Figure 6:
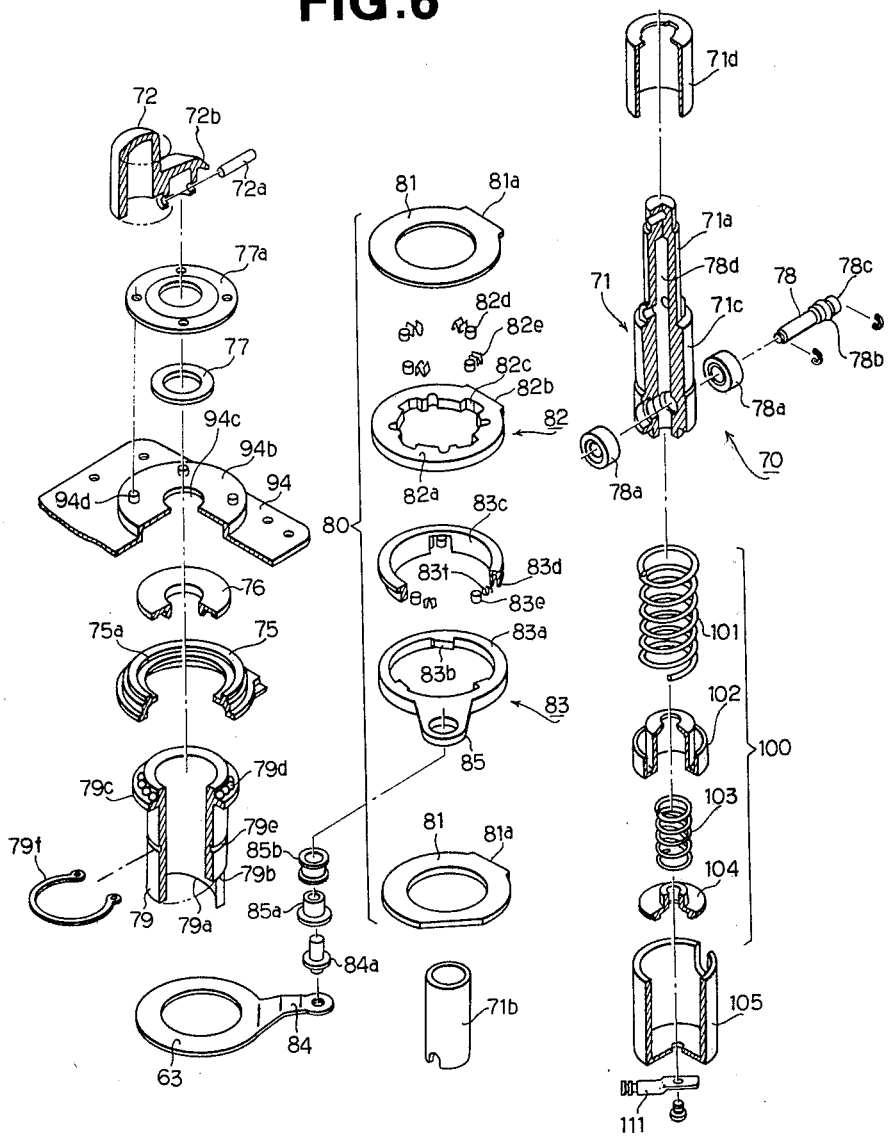
FIG. 6 is a perspective view of means for a low-speed action involved in the device of FIG. 1, as illustrated in pieces.

The one-way clutch 83 acts to be frictionally engaged with the cam member 79 when the clutch member 83*a* is advanced to a direction of the arrow line indicated in FIG. 6 in a manner to push the rollers 83*e* to the periphery of the cam member 79, and the one-way clutch 83 acts not to transmit the reverse turning motion to the cam member 79, because the clutch member 83*a* is moved backwards to an opposite direction in a manner to carry the rollers 82*e* against the springs 83*f,* thereby to intermittently transmit the turning motion from the orbital motion member 63 to the cam member 79. In this case, one of the one-way clutches 83 acts to transmit the advancing power to the corresponding cam member 79, when the other of the one-way clutches 83 acts not to transmit the power to the other corresponding cam member 79, because the corresponding orbital motion members 63, i.e., the turning arms 85 are moved to opposite turning directions.

Since the springs 101 and 103 bias the reciprocating members 71 upwards, the cam follow 78*b* is guided along the cam surface 79*a* when the cam member 79 is intermittently carried by the swing stroke of the turning arm 85, thereby to carry the reciprocating member 71 downwards with the spring bias being charged.

When the cam member 79 finishes one rotation, the cam follow 78*b* reaches the stepped portion 79*b,* and then the reciprocating member 71 is quickly carried upwards due to the discharge of spring bias, whereby the therapy member 72 runs upwards to knock a human body through the elastic belt 123 and flexible touching sheet 122. Such operation cycle is repeated.

The degree of the bias of the springs 101 and 103 is defined by set position of the means 110 for releasing and adjusting bias. When the hook portion 113*a* is disengaged from any stepped portions 115*b,* the supporter 104 is positioned to the lowest point so that the cam follow 78*b* touches to the cam surface 79*a* by minimum bias of the springs 101 and 103. Accordingly the reciprocating member 71 is vertically moved by means of cam member 79 under the least bias given only by the flexibility of the spring 103 weaker to the spring 101.

When the hook portion 113*a* is engaged to one of the stepped portions 115*b,* the supporter 104 is positioned to either one of the upper joints so that the cam follow 78*b* touches to the cam surface 79*a* by selected bias of the springs 101 and 103. Accordingly, the reciprocating member 71 is vertically moved by means of cam member 79 under the large bias given by the flexibility of the springs 101 and 103 corresponding to the selection of the stepped portions 115*b.* The selection of the stepped portions is given by the operation of the operation lever 114 and the push button 116.

Figure 9:
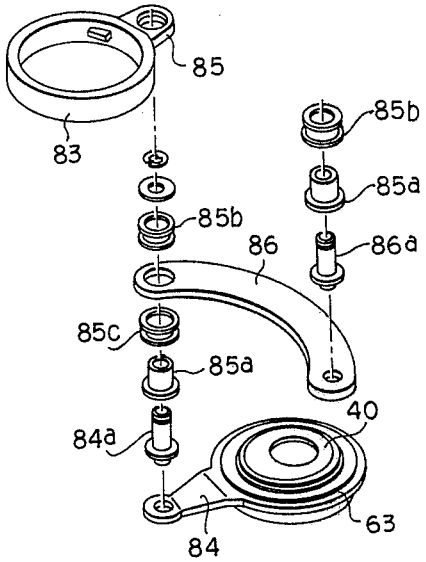
FIG. 9 is a perspective view of means for reciprocating involved in another embodiment of this invention, as illustrated in pieces.

In this embodimemt, the motion changing means 80 may be modified to that illustrated in FIG. 9. In the embodiment, the motion changing means 80 comprises only one crank motion element 84 (though the first embodiment includes two crank motion elements), and two turning elements 85 corresponding to two vertical dynamic motion means 70, one of which is reciprocatingly driven by the crank motion element 84 and the other of which is reciprocatingly driven by the crank element 84 via a link element 86. In detail, the crank motion element 84 is integrally formed to an orbital motion member 63 which exists in the embodiment of FIG. 9 and has a pivot pin 84*a* which is rotatably inserted to a hollow sleeve 85*a* which is attached to the turning arm 85 via a rubber ring 85*b* and pivoted to the link element 86 via a rubber ring 85*c*. The other turning element 85 (not shown) has a rubber ring 85*b* and hollow sleeve 85*a* as the same as that mentioned above, the sleeve 85*a* being rotatably fitted to a pivot pin 86*a* included in the link element 86. In that case where the multi-therapeutic device includes three or more vertical dynamic motion means with the corresponding therapy members, there may be provided three or more turning elements 85 and one or more link elements 86, and then at least one of the turning elements 85 are reciprocatingly driven by the crank motion element 84 directly and the others of the turning elements 85 are reciprocatingly driven by the crank motion element 84 via one or more link elements 86.

Figure 10:
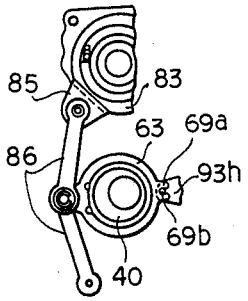
FIG. 10 is a plane view of means for reciprocation involved in the third embodiment of this invention, as illustrated in part.
Figure 11:
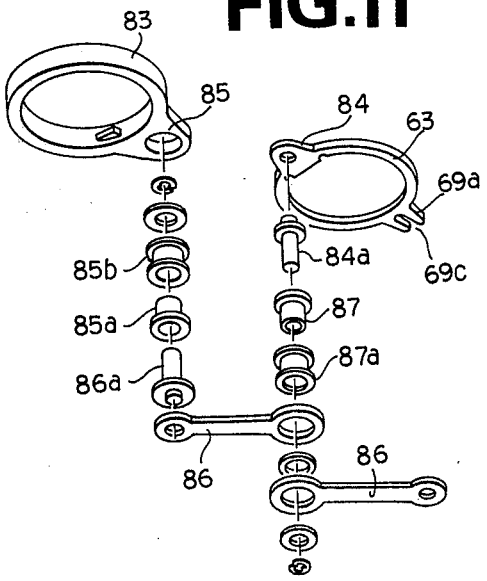
FIG. 11 is a perspective view of the means involved in the device of FIG. 10, as illustrated in pieces.

FIGS. 10 and 11 indicates the third embodiment of the motion changing means 80. In this embodiment, the motion changing means 80 comprises only one crank motion element 84 as identified to that of the second embodiment mentioned above, and two link elements 86 through which turning elements 85 are associated with the crank motion element 84. In detail, the crank motion element 84 is integrally formed to an orvital motion member 63 and has a pivot pin 84*a* which rotatably inserted to a hollow sleeve 87 which is rotatably supported via a rubber ring 87*a* to both link elements 86. The link element 86 has a pivot pin which is rotatably inserted to a hollow sleeve 85*a* which is attached to the turning elements 85 via a rubber ring 85*b*. The orbital motion member 63 specially includes a pivot supporter 69 consisting of a fork-shape member 69*a* integrally formed to the orbital motion member 63, and a pivot pin 69*b* disposed to a bracket 93*h* formed to the inner frame 93 (not shown) and slidably inserted to a slit 69*c* formed to the fork-shape member 69*a*. Accordingly, the crank motion element 84 is swung under the orbital motion of the member 63 restricted by the pivot supporter 69.

FIG. 12 indicates the fourth embodiment of the motion changing means 80. In this embodiment, the motion changing means 80 comprises an orbital motion member 63 rotatably fitted with the eccentric periphery 43 of the rotor block 40, a square motion element 88 having a pare of parallel-arranged rails 88*a* along which an orbital motion member 53 is slidably moved and a pair of pieces 88*b* integrally formed to the orbital motion member 63 at both sides thereof, the pieces 88*b* being guided slidably to a direction normal to the slidable motion of the orbital motion member 63 along the rails 88*a* (guide means thereof are not shown in FIG. 12), and a pair of fork guides 88*c* integrally formed to both ends thereof, the guides 88*c* elongating in a direction parallel to the slidable motion of the orbital motion member 63, i.e., that of the rails 88*a*. To slide along the fork guides 88*c* are pivot pieces 88*d* each having side grooves 88*e* slidably fitted with the fork guide 88*c*. The pivot piece 88*d* involves a hollow sleeve 88*f* inserted to a bore formed to the pivot piece 88*d* via a rubber ring 88*g* and rotatably fitted with a pivot pin 84*b* attached to a crank motion element 84. Accordingly, the orbital motion member 63 substantially transmit to the square motion element 88 only the reciprocating motion compornent of the orbital motion, which depends upon a direction normal to the rail 88*a*, whereby the crank motion element 84 is reciprocated with the piece 88*d* sliding along the fork guide 88*c*.

FIG. 13 indicates a modification from that of FIG. 12. In this embodiment, the motion changing means 80 specially comprises a link member 86 in stead of the fork guide 88*c* and pivot piece 88*d*. The link member 86 has a pivot pin 86*a* which is rotatably inserted to a hollow sleeve 88*f* which is attached via a rubber ring 88*g* to a bore formed to the end of the square motion element 88. A pivot pin 85*d* attached to the turning element 85 is rotatably fitted with a hollow sleeve 86*b* which is attached to the link member 86 via a rubber ring 86*c*.

An attachment for kneading operation is indicated in FIGS. 14 to 17. The attachment includes a head member 140 detouchably attached to the installing base member 124 instead of the head member 120, a swingable means 141 with a kneading head 142, a cooperable means 143 with a kneading head 144, bias means 145 for kneading operation, an action means 146 for driving the bias means 145, and means 147 for disengageably interlocking the action means 146 to the hook portion 72*b* of the dynamic therapy member 72.

The head member 140 comprises a base plate 140*a* to be set on the installing base plate 124, a housing 140*b* for installing the mechanism of the attachment mentioned above, a cover 140*c* for containing the mechanism, and a pair of clampers 140*d* pivoted by means of pins 140*e* to both end portions of the housing 140*b*. Each of the clampers 140*d* includes a clamping roller 140*f* made of rubber pivoted to the lower end thereof, two handling portions 140*g* and 140*h*, and a tension spring 140*i* shaped into a coil, one end of which is engaged to the middle portion of the clamper 140*d* and the other end of which is engaged to the bracket 140*j* mounted on the interior of the housing 140*b*. Accordingly, the clamper 140*d* acts to fasten the base plate 140*a* to the installing base member 124, with the clamping roller 140*f* turning to the under place of the brim of the installing base member 124 when the handling portion 140*h* is pushed and being maintained thereto by means of the spring 140*a*.

In order to disengage the base plate 140*a* from the installing base member 124, the clamping roller 140*f* is withdrawn from the under place of the brim of the installing base member 124 with the handling portion 140*g* being upwardly pushed.

The swingable means 141 comprises a swinging lever 141*a* pivoted to the housing 140*b* by means of a pin 141*b*, to the upper end of which the kneading head 142 is rotatably supported, and a piece 141*c* for adjusting the swinging angle of the lever 141*a*, the piece 141*c* having a female-screw 141*d* and a pivot portion 141*e*.

The kneading head 142 comprises a head body 142*a*, a cushion member 142*b* surrounding the head body 142*a*, and an adjusting male-screw 142*c* extending into a hollow space formed to the upper portion of the swing lever 141*a* and turnably threaded to the female-screw 141*d*.

The cooperable means 143 comprises a swinging lever 143*a* pivoted to the housing 140*b* by means of a pin 143*b*, to the upper end of which the kneading head 144 is stationally attached, a fitting groove 143*c* formed to the upper portion of the lever 143*a*, and a bias spring plate 143*d* attached to the upper portion of the lever 143*a* at the side opposite to that where the groove 143*c* is positioned.

The kneading head 144 comprises a hollow cylindrical head body, 144*a*, a cushion member 144*b* attached to the operating side thereof, and an engaging protrusion 144c formed to the inside of the head body 142a so as to be inserted into the groove 143c. And then the head 142 is detouchably attached to upper end of the lever 143a by means of engagement of the protrusion 144c and groove 143c and bias of the spring plate 143d.

The cooperable means 143 further includes a connecting member 143e the end of which is pivoted to the lever 143a by means of a pin 143f and the other end of which is pivoted by means of a pin 143g to a lower portion 141f extending downwards from the swinging lever 141a. The connecting member 143e is always biased by means of a coiled tension spring 143h having two ends, one of which is attached to the connecting member 143e and the other of which is hung to the pin 143f. Accordingly, the upper ends of the swinging levers 141a and 143a, i.e., the kneading head 142 and 144 are biased to an opposite direction so as to be far from each other.

The bias means 145 comprises an oil plunger pump 151, a check valve assembly 152, a flexible oil tank 153, a piston cylinder actuator 154, and a spool valve 155.

The oil plunger pump 151 includes a cylindrical housing 151a attached to a bracket 145a mounted on the housing 140b, an oil chamber 151b formed in the housing 151a, and a plunger piston 151c slidably and hydro-tightly inserted into the chamber 151b.

The check valve assembly 152 includes a valve body 152a having an inlet port 152b, an outlet port 152c and a pumping port 152d; a check valve 152e with a valve ball 152f biased by a spring member 152g and placed between the inlet port 152b and pumping port 152d; a check valve 152h with a valve ball 152i biased by a spring member 152k and placed between the pumping port 152d and the outlet port 152c; and an oil supply valve 152l mounted to the end of the valve body 152a so as to communicate with the inlet port 152b.

The flexible tank 153 includes a bellows 153a disposed in the housing 140b and a port 153b formed to the lower end portion of the bellows 153a.

The piston cylinder actuator 154 includes a hollow cylinder body 154a, a chamber 154b formed in the interior of the body 154a, a piston 154c slidably and in hydro-tightness inserted into the chamber 154b, a piston rod 154d connected to the piston 154c and pivoted to the pivot portion 141e of the piece 141c, and a journal axis 154e rotatably attached to the lower end of the body 154a and supported to the housing 140b, the journal axis 154e having a circular path 154f communicating with a chamber port 154g formed to the lower end of the chamber 154b and with a center path 154h formed in the journal axis 154e, the center path 154h communicating with a cross path 154k formed to the end of the journal axis 154e supported to a bearing 154l.

The spool valve 155 includes a cylinder body 155a, a spool member 155b having two slidable blocks 155c and 155d arranged in tandem so as to separate the interior of the cylinder body 155a into two oil pressure chambers 155e and 155f, and two ports 155g and 155h formed to the side of the cylinder body 155a. The port 155g always communicates with the chamber 155e, and the port 155h is capable of communicating with the chamber 155f after the spool member 155b is carried to the right side shown in FIG. 14. At the same time, the port 153b communicates with the chamber 155f via an oil communicating tube 156a. Oil communicating tubes 156b, 156c and 156d serially join to each other so as to communicate the outlet port 152c with the ports 155g and 155h and a cross path 154k formed in the end of the journal axis 154e. An oil communicating tube 156e is adapted to communicate the inlet port 152b with the port 153a of the tank 153.

In order to push the free end of the spol member 155b, there are provided a bell-crank member 161 pivoted to the pin 141b with its free end being depressed to the outer free end of the spool member 155b, and a link rod 162 having two pivots one of which is connected to the end of the bell-crank member 161 and the other of which is connected to the piece 141c at the same position as that pivoting the piston rod 154j.

The driving means 146 consists of a block piece 146a secured to the top of the piston 151c of the plunger pump 151 and a coiled compression spring 146b disposed between the block piece 146a and housing 151a so as to urge the block piece 146a thereby to cause the plunger 151c returned to the upper position.

Figure 14:
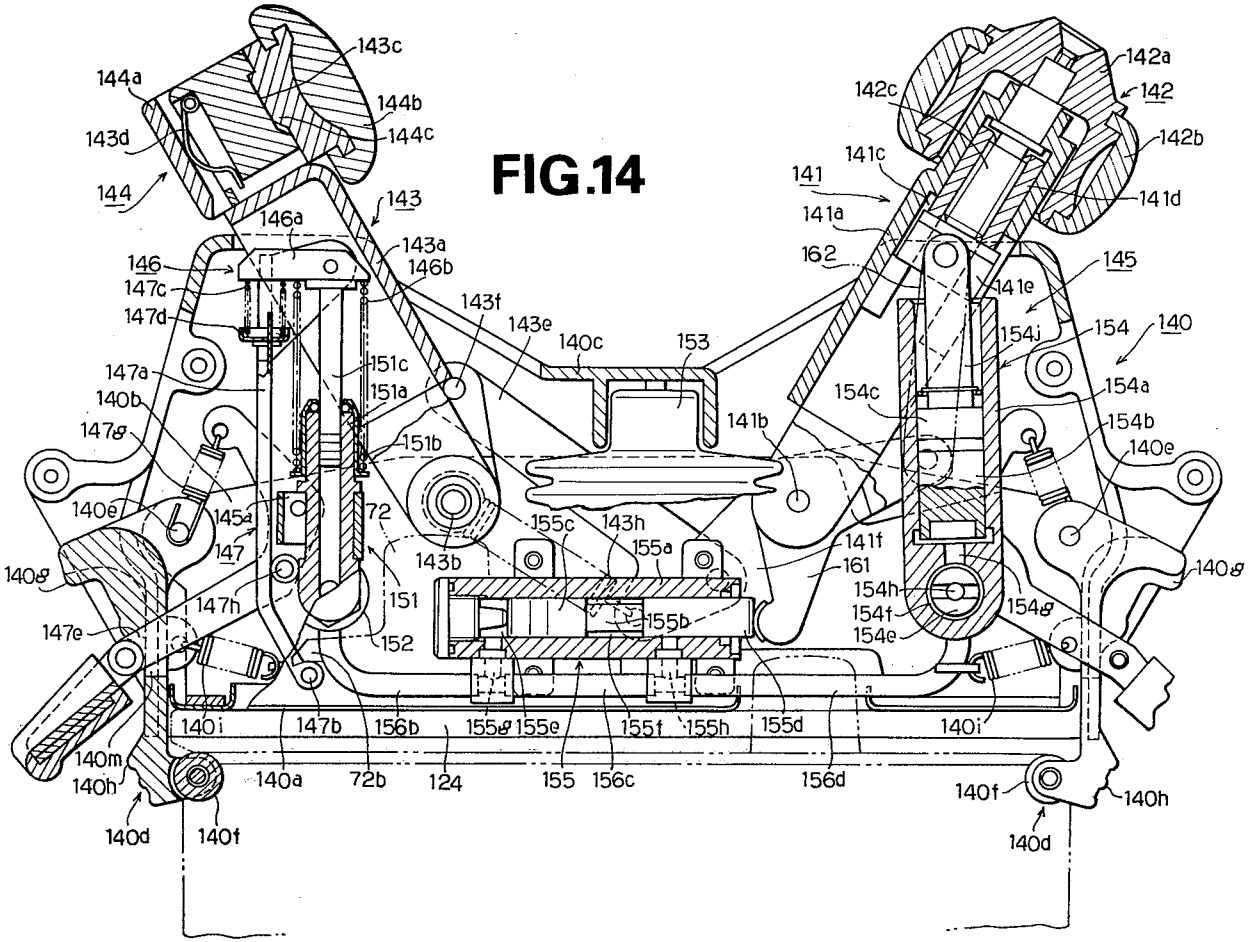
FIG. 14 is a cross-sectional front elevation of an attachment for kneading additionally involved in the device of this invention.
Figure 15:
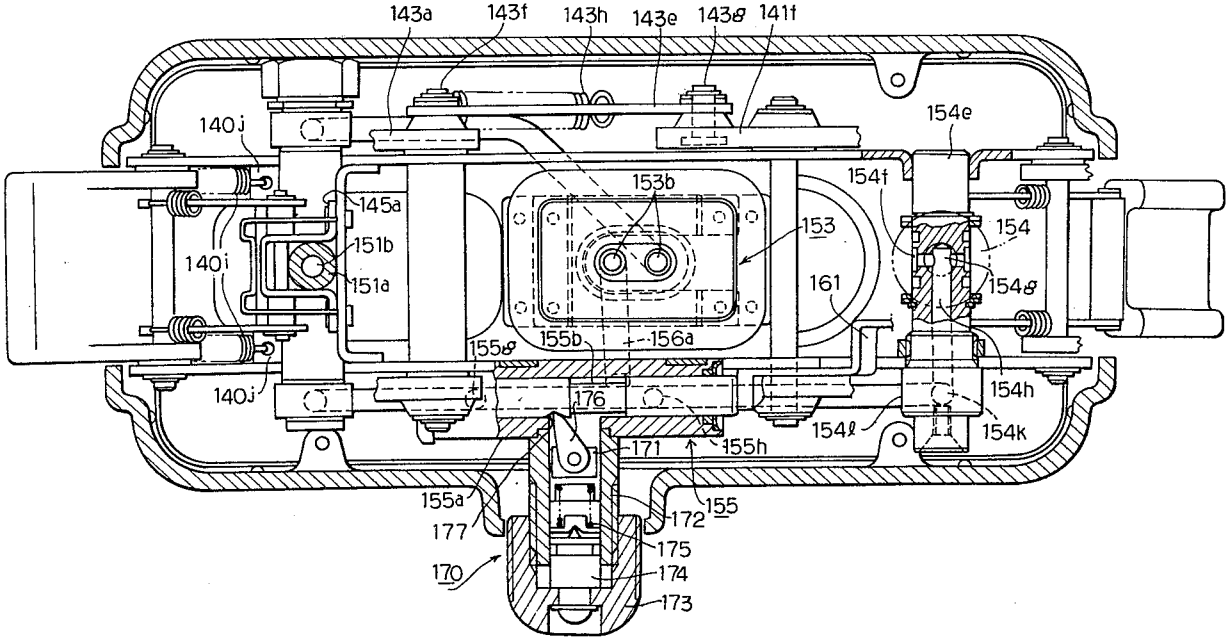
FIG. 15 is a cross-sectional plane of the attachment illustrated in FIG. 14.
Figure 16:
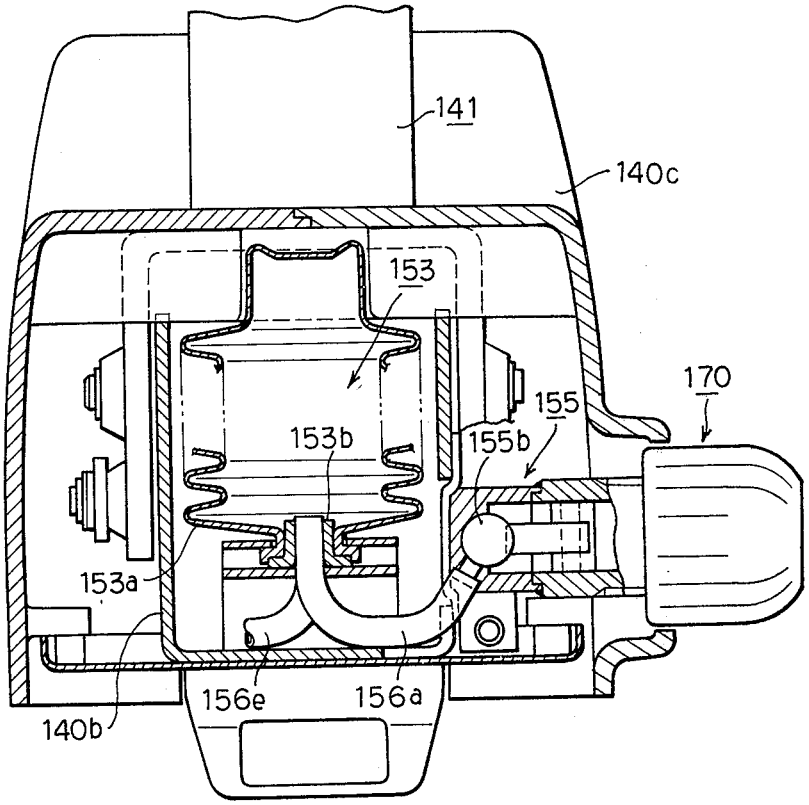
FIG. 16 is a partial cross-sectional side elevation of the attachment illustrated in FIG. 14.
Figure 17:
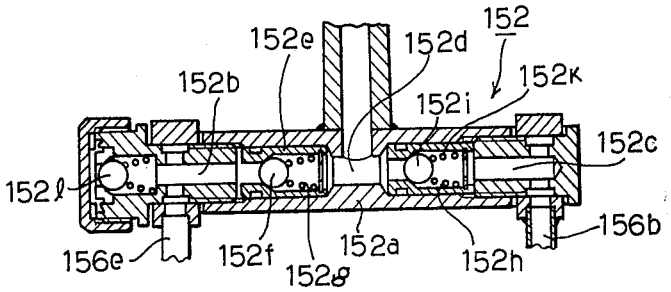
FIG. 17 is a cross-sectional side elevation of the check valve assembly involved in the attachment of FIG. 14.
Figure 18:
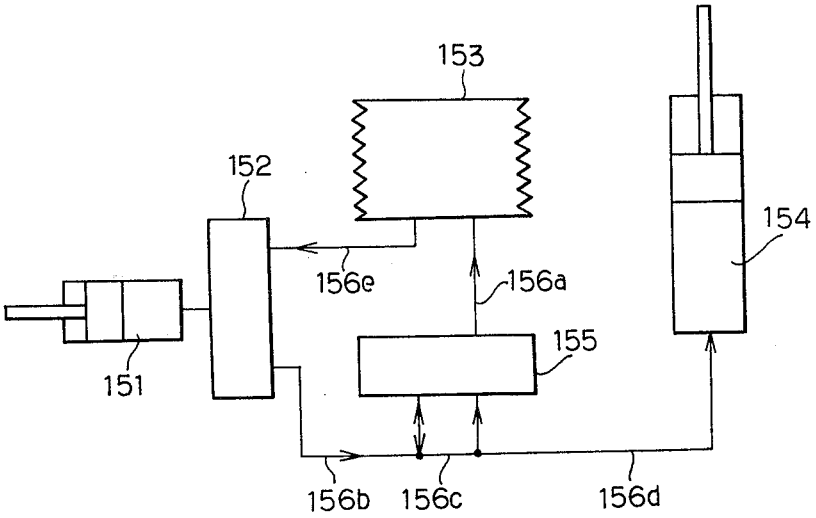
FIG. 18 is a diagramatical view of an oil control system involved in the attachment of FIG. 14.
Figure 25:
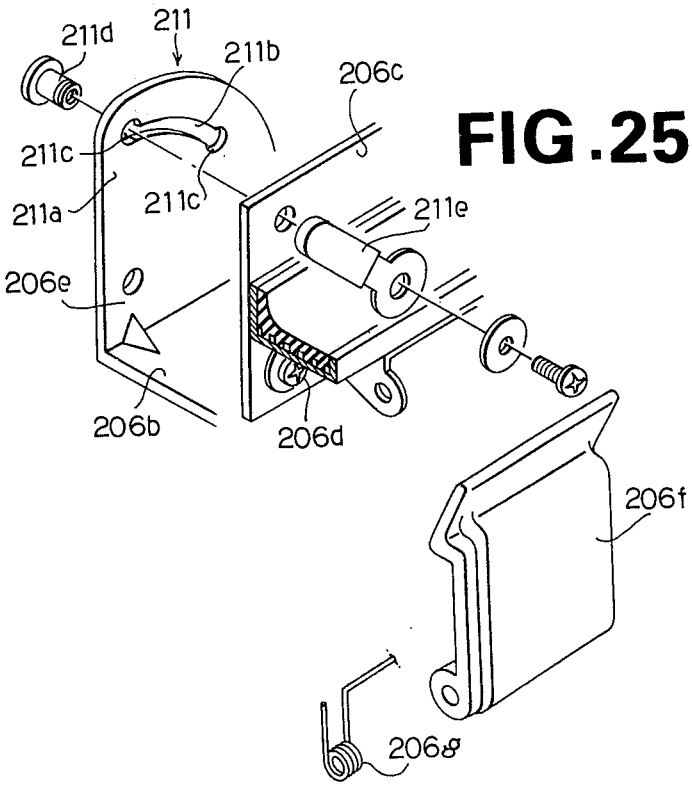
FIG. 25 is a perspective view of the reclining means for the therapy device involved in the bed of FIGS. 19 (A) and (B)
Figure 19:
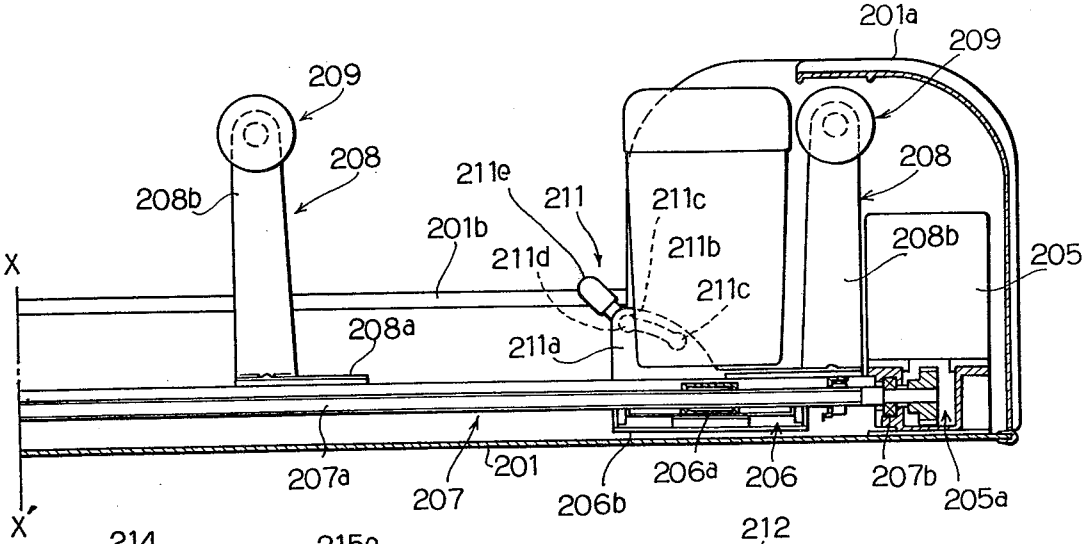
FIGS. 19 (A) and (B) are cross-sectional front elevations of a foldable therapy bed, also used as a therapy chair, embodying a combination with the multi-therapeutic device in this invention, as separated to two blocks by a line of X–X'.
Figure 19:
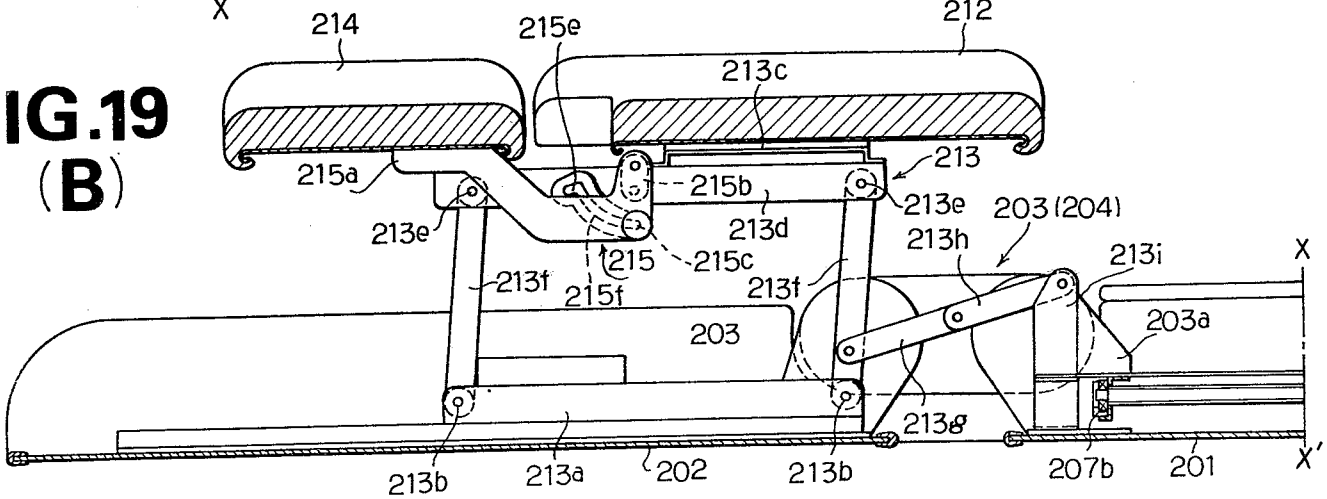
Figure 20A:
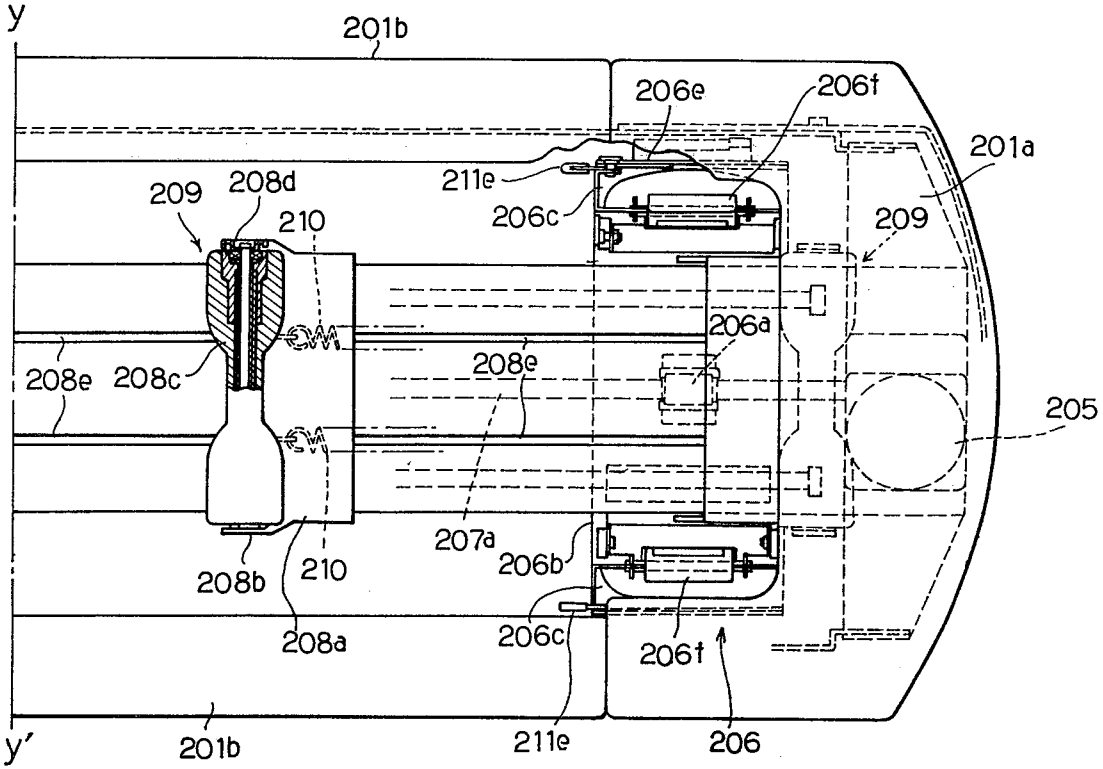
FIGS. 20 (A) and (B) are planes of the therapy bed of FIGS. 19 (A) and (B), as separated to two blocks by a line of Y–Y'.
Figure 20B:
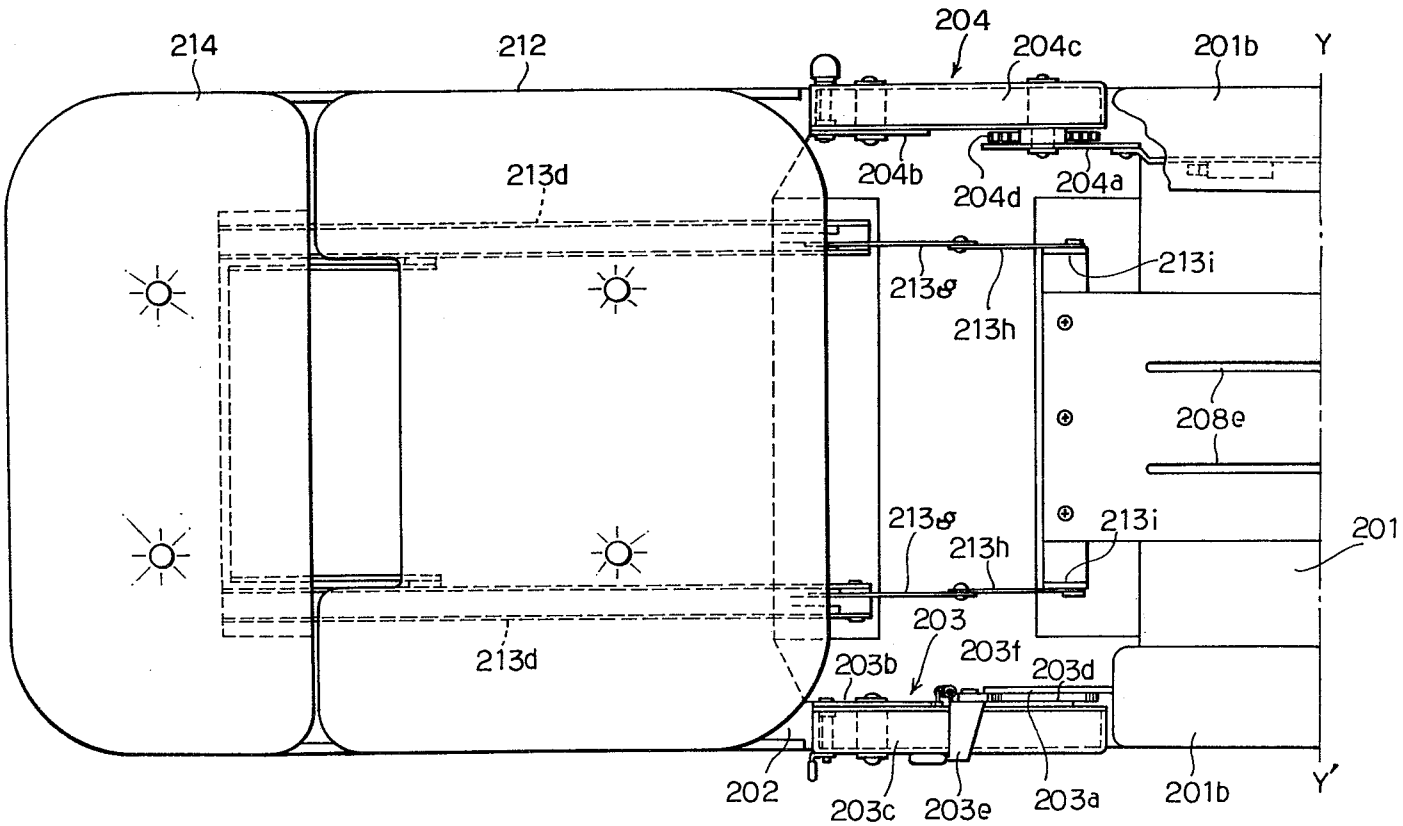
Figure 21:
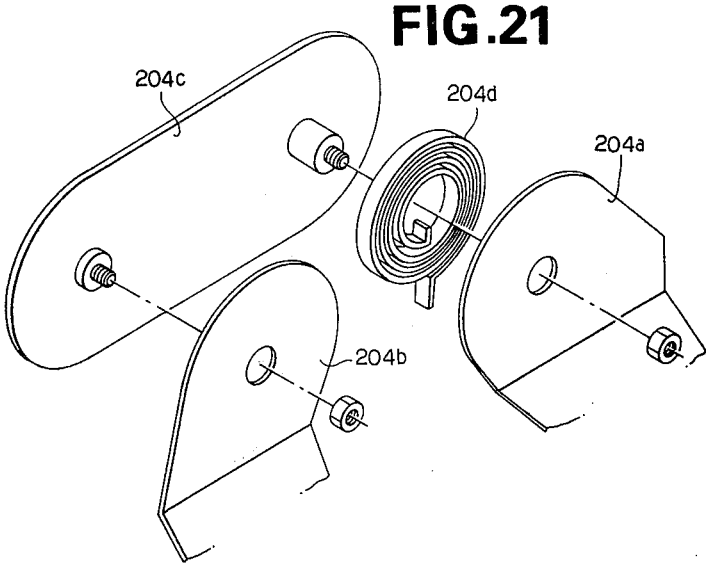
FIG. 21 is a perspective view of folding parts involved in the bed of FIGS. 19 (A) and (B), as illustrated in pieces.
Figure 22:
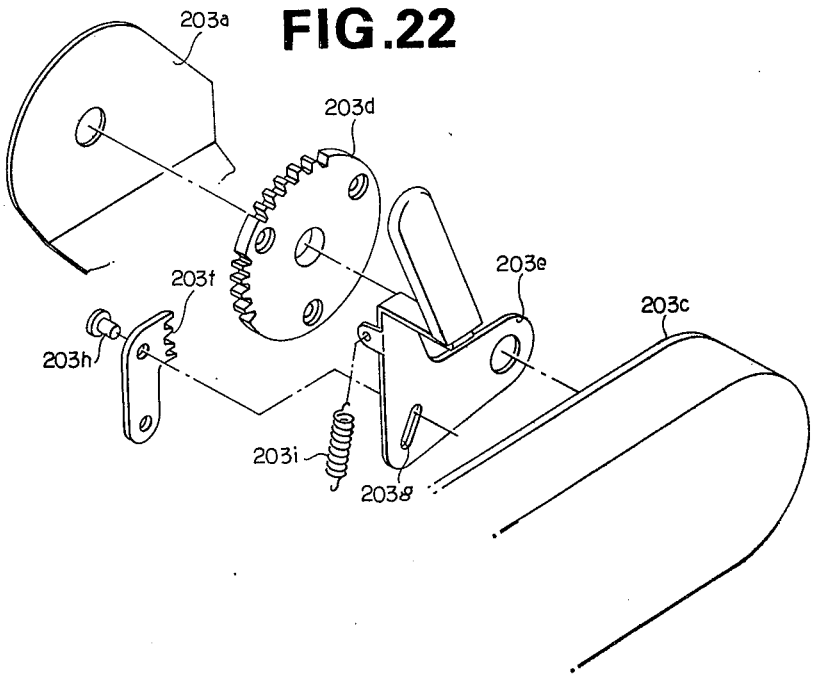
FIG. 22 is a perspective view of the other folding parts illustrated in the bed of FIGS. 19 (A) and (B), as seen in pieces.
Figure 23:
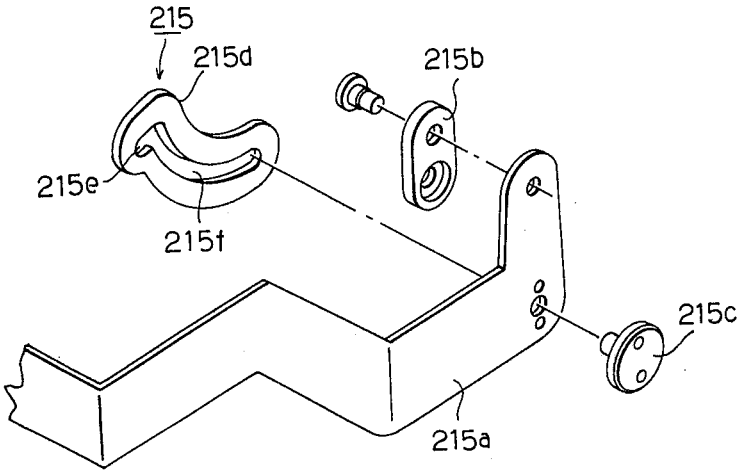
FIG. 23 is a perspective view of a reclining means for a cushion member involved in the bed of FIGS. 19 (A) and (B), as illustrated in pieces.
Figure 24:
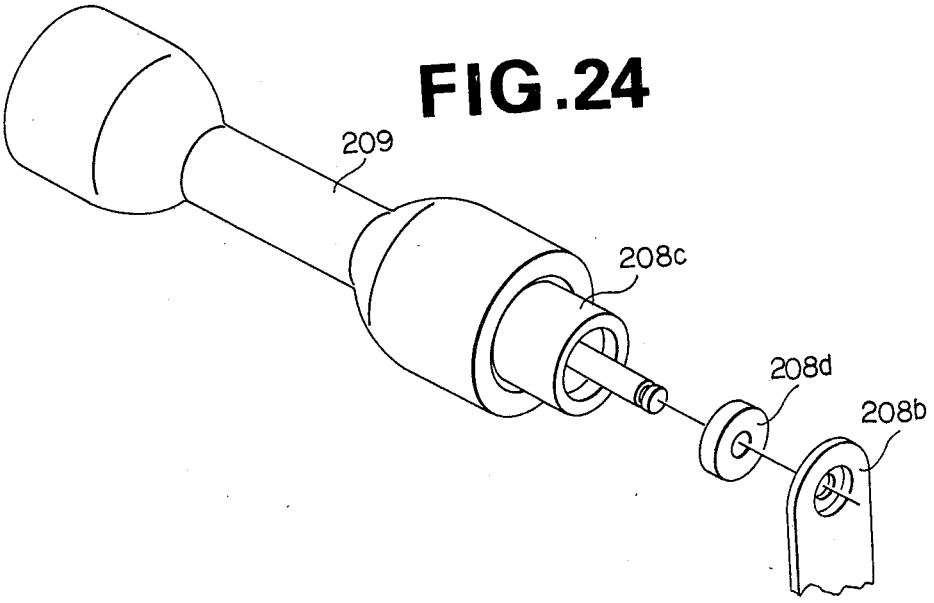
FIG. 24 is a perspective view of the supporting means involved in the bed of FIGS. 19 (A) and (B), as illustrated in pieces.
Figure 26:
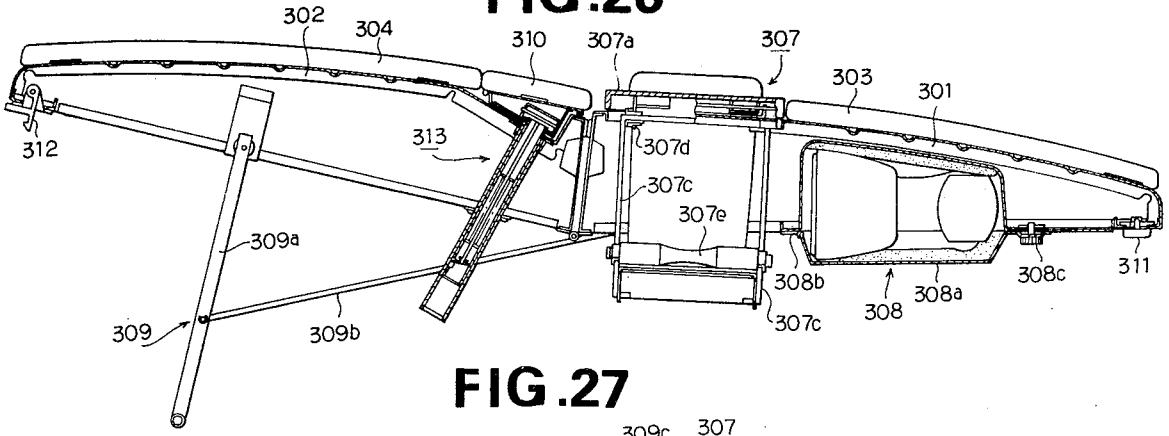
FIG. 26 is a cross-sectional front elevation of another embodiment of a therapy bed, foldable to be formed into a hand-bag, which is combined with the multi-therapeutic device.
Figure 27:
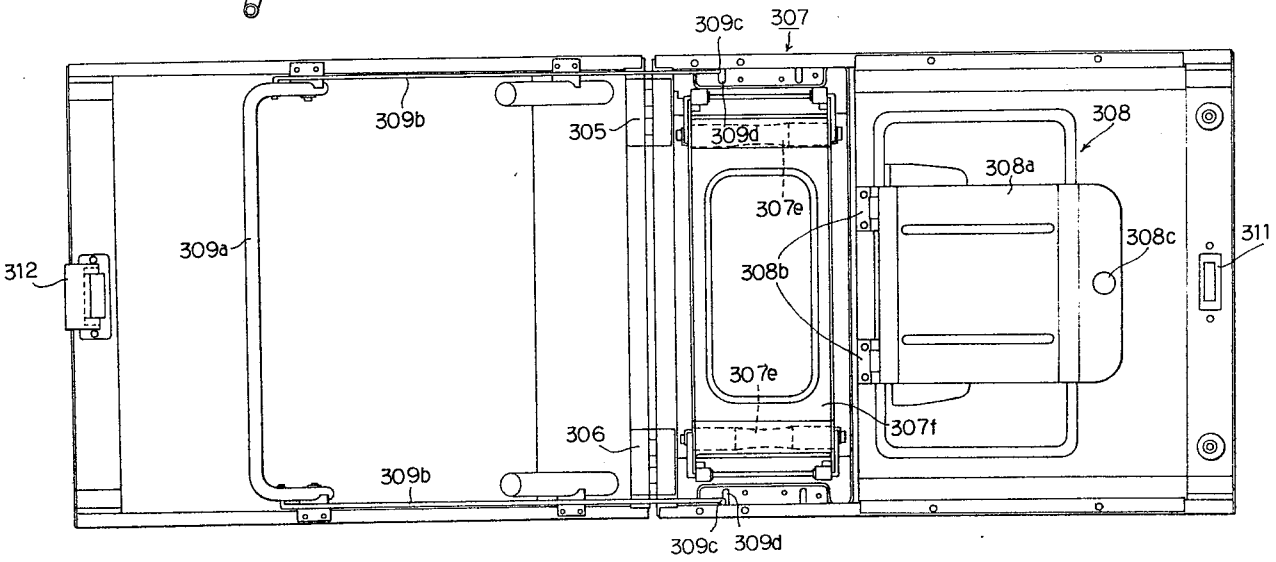
FIG. 27 is a plane view of the therapy bed of FIG. 26.
Figure 28:
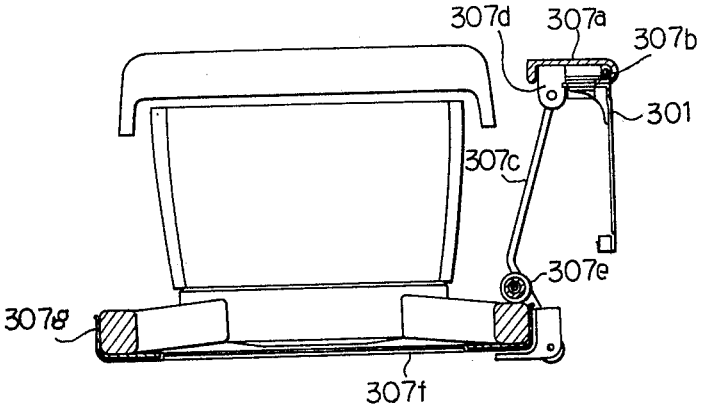
FIG. 28 is a cross-sectional side elevation of the therapy bed of FIG. 26.
Figure 29:
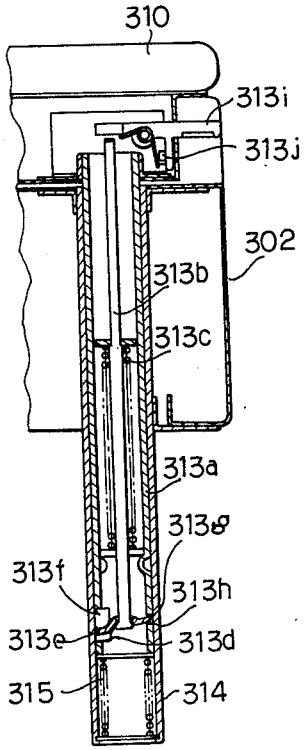
FIG. 29 is a cross-section of an adjustable positioner for a cushion member involved in the bed of FIG. 26.

The interlocking means 147 comprises a vertical motion member 147a having a lock pin 147b mounted on the lower end of the member 147a, the member 147a being pivoted to the block piece 146a, a small diameter coiled compression spring 147c disposed between the block piece 146a and a spring receiver 147d secured to the member 147a so as to urge the member 147a in an anti-clockwise direction in FIG. 14 thereby to advance and keep the lock pin 147b to an interlock position with the hook portion 72b.

The interlocking means 147 further includes a disengaging lever 147e pivoted to the bracket 145a by means of a pin 147f, a bias spring 147g stretching between the upper end of the lever 147e and the pin 140e, and an operating pin 147h. The lower portion of the lever 147e extends outwards through a bore 140m formed to the clamper 140d. Accordingly, the lower portion of the lever 147e is pulled upwards so as to push the member 147a by the operating pin 147h thereby to cause the lock pin 147b removed from the interlock position of the hook portion 72b toward the left side in FIG. 14.

In this embodiment, when the base plate 140a is set on the installing base plate 124 with the clampers 140d, the releasing rod 118 is downwardly shifted with the base plate 140a pushing the top of the releasing rod 118 thereby to disengage the hook portion 113a from the stepped portions 115b. Accordingly, the bias means 100 is released so that the reciprocating member 71 is operated under the condition of non-bias or less-bias.

In this embodiment, there is further provided means for adjusting the pressure of the kneading operation by combination with the spool valve 155. The adjusting means 170 includes a slider 171 movably inserted into a cylinder 172 integrally secured to the cylinder body 155a, a dial handle 173 adjustably screwed to the cylinder 172, a pusher 174 attached to the handle 173 and inwardly extending to the cylinder 172, a bias spring coil 175 disposed between the pusher 174 and slider 171, and a toggle member 176 with a sharp end pivoted to the slider 171 and engaging and a V-shaped groove 177 formed to the periphery of the block 155c of the spool member 155b. And then, the spool member 155b is, by the thrust component of the bias of the spring coil 175, settled to either one of the end positions after being shifted by the oil pressure applied to the chamber 155e or the mechanical force applied to the free end of the spool member 155b by the motion of the bell-crank member 161.

In operation, when the head member 140 is set on the installing base plate 124 and the lock pin 147b is engaged to the hook portion 72b, the vertical motion member 147*a* is downwardly moved by the bias given to one of the dynamic therapy member 71 due to the cam member 79 which is intermittently carried, meanwhile the cam follow 78*b* is guided along the cam surface 79*a*. And then the planger 151*c* is intermittently shifted downwards so as to compress the oil filled in the oil chamber 151*b*, whereby the oil pressure is applied to the chamber 155*e* via the check valve 152*h*, port 152*c*, tube 156*b* and port 155*g*, and simultaneously the pressure oil is supplied to the chamber 154*b* via the check valve 152*h*, port 152*c*, tubes 156*b*, 156*c* and 156*d*, pathes 154*k*, 154*h* and 154*f*, and the chamber port 154*g*, so as to push the piston 154*c* upwards. The motion of the piston 154*c* is transmitted through the piston rod 154*d* to the piece 141*c*, i.e., the swinging lever 141*a*, so that the kneading head 142 is moved toward the left side and the swinging lever 141*a* causes the swinging lever 143*a* turned toward the right side through the connection member 143*e* thereby to move the kneading head 144 toward the right side.

Accordingly, the part of the human body to be treated is depressed between the kneading head 142 and 144.

When the back pressure to the oil chamber 154*b* is increased due to the depression force to the human body to a suitable degree (which is defined by the setting of the adjusting means 170 as described thereafter), the spool member 155*b* is carried by the pressure applied to the chamber 155*e* toward the right side in FIG. 14, against the thrust component of the spring bias of the spring coil 175 given to the spool member 155*b* through the toggle member 176.

When the toggle member 176 is turned over its neutral point, the spool member 155*b* is forcedly carried to the right side by the opposite thrust component of the bias of the spring 175 changed by the toggle motion of the toggle member 176, thereby to cause the chamber 155*f* communicated to the tank 153 via the tube 156*a* and port 153*b* and simultaneously to the port 115*h* and tube 156*c*. Consequently, the pressure oil is released through the chamber 155*f* from the high pressure area, i.e., the tubes 156*b*, 156*c* and 156*d*, pathes 154*k*, 154*h* and 154*f* and the chambers 154*b* and 155*e*, to the lower pressure area, i.e., the tank 153.

Accordingly, the swinging levers 141*a* and 143*a* are returned to the opposite direction by the bias of the spring 143*h*, and thereafter the spool member 155*b* is returned to the left side by the pushing operation of the bell-crank member 161 which is moved together with the lever 141*a*.

In an independent relation with the operation of the swinging levers 142 and 144 mentioned above, when the cam follow 78*b* reaches the stepped portion 79*b*, the vertical motion member 147*a* is upwardly moved by the bias of the spring 146*b* and the back pressure is applied to the oil chamber 151*b* in minus, thereby to introduce the oil from the tank 153 via the tube 156*e*, port 152*b* and check valve 152*e* to the chamber 151*b*. Accordingly, the planger pump 151 is driven to pumping operation.

The kneading operation in this embodiment is repeated by such cycle mentioned above.

In this embodiment, when the kneading head 142 is rotated, the screw 142*c* is turned to the female-screw 141*d* so that the piece 141*c* is shifted along the longitudinal direction of the swinging lever 141*a*, thereby to cause the swinging lever 141*a* changed in accordance with its starting position.

If it is necessary to increase the kneading pressure, the handle 173 is rotated so as to advance the pusher 174 due to the threaded screw, thereby to cause the bias of the spring 175 increased. The decrease of the kneading pressure is viceversa because, the spool member 155*b* is moved to the right side in FIG. 14 when the oil pressure in the chamber 155*e* exceeds the thrust component of the spring bias mentioned above.

In this embodiment, if it is necessary to keep a suitable pressure applied to the human body for a prescribed time, there may be provided an accumulator communicating with the chamber 155*e* in a manner to delay the increase of the oil pressure in the chamber 155*e*.

FIGS. (19(A) to 25 are an illustration of a foldable therapy bed used as a therapy chair, embodying a combination with the multi-therapeutic device in this invention.

The bed comprises two separate bed frames 201 and 202; two pivot means 203 and 204 for foldably joining the bed frames 201 and 202 with each other; an electric motor 205 mounted on the bed frame 201; a carrier 206 for supporting the multi-therapeutic device, already mentioned, thereon; means 207 for guiding the carrier 206 along the longitudinal direction of the bed frame 201; a pair of means 208 for supporting a human body each having a supporter 209; bias means 210 for causing the supporting means 208 to be mutually access to each other; means 211 for incling the carrier 206; a main seat 212 mounted on a foldable supporting frame 213 attached to the bed frame 202, an auxiliary seat 214; and means 215 for setting the auxiliary seat 214 on the supporting frame 213.

In detail, the bed frame 201 includes a cushion holder 201*a* mounted on the free end portion thereof and two cushions 201*b* mounted on both sides thereof, and then the driving motor 205 disposed to the lower position of the cushion holder 201*a*.

The guiding means 207 includes a screw shaft 207*a* rotatably supported to bearings 207*b* mounted on the bed frame 201 so as to be threaded to a femal-screw 206*a* attached to the under position of the carrier 205 and to be driven by the motor 205 through helical gears 205*a* one of which is attached to the output shaft of the motor 205, and the other of which is attached to the end of the screw shaft 207*a* so that the multi-therapeutic device is capable of being carried in its travelling area defined by the guiding screw shaft 207*a*.

The carrier 206 includes a base frame 206*b*, two supporting frames 206*c* pivoted by means of pins 206*d* to both side brackets 206*e* mounted on the sides of the base frame 206*b*, and clampers 206*f* pivoted to the supporting frames 206*c* and having torsional springs 206*g* respectively so as to clamp the handle of the multi-therapeutic device.

The inclining means 211 includes a sector plate 211*a* secured to the side of the supporting frame 206*c*, a circular groove 211*b* having stational bores 211*c* with its both ends respectively, a slide pin 211*d* with a threaded screw slidably moved along the groove 211*b* and a tighting lever 211*e* having a female-screw threaded to the screw mentioned above, so that the sector plate 211*a* can be inclined together with the multi-therapeutic device when the lever 211*e* is released, and can be set in a fix position, for instance, either one of the stational bores 211*c* by the tighting operation of the lever 211*e*, i.e., the advance of the femal-screw thereof, thereby to cause the supporting frames 206*c* fixed to the side brackets 206*e*.

Each of the supporting means 208 includes a carrier 208*a* having a pair of columns 208*b*, and a bobbin 208*c* pivoted through bearings 208*d* to the upper portions of the columns 208*b*, and the carrier 208*a* can be carried in its travelling area defined by means of a pair of guide slits 208*e*. The bias means 210 in this embodiment are a pair of coiled tension springs which are stretched between the carriers 208*a* of both supporting means 208. In this embodiment, the carrier 208*a* should be supported by suitable means (not shown) in its gravitical relation.

Accordingly, the multi-therapeutic device acts to the various portions of the human body laid on his back on the bed within its travelling area during the motor 205 is rotated and then the carrier 206 travels, and fetches the supporting means 208 in their travelling area.

The foldable supporting frame 213 includes lower members 213*a* mounted on the bed frame 202, each of the lower members 213*a* having two pivots 213*b*, a seat frame member 213*c* on which the main seat 212 is mounted, upper members 213*d* attached to the under portion of the seat frame member 213*c*, each of the upper members 213*d* having two pivots 213*e*, and two pairs of leg members 213*f* each pivoted to the upper and lower pivots 213*b* and 213*e* respectively.

The setting means 215 includes a pair of arm frames 215*a*, a pair of links 215*b* each of which is pivoted to the end of the arm frame 215*a* and to the middle portion of the upper member 213*d*, a set pin 215*c*, a sector plate 215*d* attached to the upper member 213*d* and having a lock groove 215*e* and a guide circular groove 215*f* communicating with the lock groove 215*e* so that the pin 215*c* is slidably guided along the groove 215*f* and capable of engaging with the lock groove 215*e*.

The foldable supporting frame 213 further includes two pairs of link motion members 213*g* and 213*h* which are mutually pivoted and the free ends of which are pivoted to the leg member 213*f* and a bracket 213*i* mounted on the bed frame 201.

The pivot means 203 and 204 each includes two bearing brackets 203*a* (204*a*) and 203*b* (204*b*), the former being mounted on the bed frame 201 and the latter being mounted on the bed frame 202, and a link member 203*c* (204*c*) pivoted to the brackets 203*a* (204*a*) and 203*b* (204*b*) at its both ends.

The pivot means 203 further includes a disc 203*d* having a plurality of groups of intermittent gear teeth, which is coaxial to the pivot of the bracket 203*a* and fixedly secured to the bracket 203*a*, a lock lever 203*e* with a rack 203*f* capable of being engaged with the gear teeth, a guide slit 203*g* formed to the lock lever 203*e*, a guide pin 203*h* attached to the link member 203*c* so as to insert into the slit 203*g*, and a tension spring 203*i* for biasing the lock lever 203*e* in a manner to engage the rack 203*f* with the gear teeth.

The pivot means 204 further includes a wound spring member 204*d* one end of which is secured to the bracket 204*b* and the other end of which is secured to the link member 204*c*.

Accordingly, when the rack 203*f* is selectively engaged with the gear teeth, the bed frames 201 and 202 are mutually inclined at a suitable angle in a manner to be set in a chair. If the rack 203*f* is disengaged from the gear teeth by the operation of the lock lever 203*e* against the bias of the spring 203*i*, the bed frames 201 and 202 are moved by the bias of the wound spring member 204*d* in a manner to be aligned in a straight condition used as a bed.

FIGS. 26 to 29 indicates another foldable bed used in combination with the multi-therapeutic device. The bed comprises two bed frames 301 and 302 with seat mats 303 and 304, the bed frames 301 and 302 being mutually pivoted by means of hing members 305 and 306; means 307 for holding the multi-therapeutic device; a container 308 disposed to a dead space of the bed frame 301; a supporting means 309 disposed to the frame 302; and an auxiliary mat member 310 mounted on the bed frame 302.

The means 307 for holding the multi-therapeutic device includes a pair of hing members 307*a* pivoted to the side portions of the bed frame 301 by means of hing pins 307*b*; a pair of U-shaped hanger lods 307*c*, the both upper ends of which are pivoted to brackets 307*d* secured to the hing members 307*a* respectively; a pair of clamping rollers 307*e* pivoted to the lower portions of the hanger lods 307*c*; and a holding base 307*f* having a brim 307*g* surrounding the base 307*f*, the holding base 307*f* being supported to the lower portions of the hanger lods 307*c*.

Accordingly, as turning the hing members 307*a*, the hanger lods 307*c* are upwardly moved so that the base 307*f* is upwardly shifted thereby to cause the multi-therapeutic device detouchably set on the base 307*f*, and as turning the hing members 307*a* to the opposite direction, the hanger lods 307*c* are downwardly moved so that the base 307*f* together with the therapeutic device is lowered and the handle portions of the therapeutic device are clamped by the clamping rollers 307*e* being shifted toward inside.

The container 308 has a cover 308*a* hinged to the frame 301 by means of hings 308 and a stop screw 308*c* for keeping the cover 308*a* in the close condition, so that the attachment for the multi-therapeutic device is contained in the container.

The supporting means 309 includes an U-shaped leg 309*a* pivoted to the sides of the frame 302, and a pair of hook rods 309*b* pivoted to the leg 309*a* and having L-shaped hooks 309*c* which are detouchable engaged with grooves 309*d* formed to the sides of the frame 301. When the bed frames 301 and 302 are folded in a manner to form into a hand-bag shape, the hooks 309*c* are disengaged from the grooves 309*d* and the leg 309*a* is turned toward the free end of the frame 302 and used as a handle. In order to use the bed as a hand-bag, the frames 301 and 302 have a couple of lock members 311 and 312 secured to both free ends thereof.

The auxiliary mat member 310 is supported to the frame 302 via means 313 for elevating the mat member 310. The elevating means 313 includes two hollow cylinders 313*a* slidably inserted into holding cylinder frames 314 attached to the sides of the frame 302 and upwardly biased by means of compression springs 315 disposed to the lower portions of the cylinder frames 314; shift rods 313*b* movably inserted into the cylinders 313*a* respectively and upwardly biased by means of compression springs 313*c*; engaging pieces 313*d* swingably secured to the lower ends of the shift rods 313*b* respectively, each of which has an frictional engaging top 313*e* facing to the inner periphery of the cylinder frame 314 through a window 313*f* formed to the periphery of the cylinder 313*a* and a swing point 313*g* inserted to a journal 313*h* formed to the inner periphery of the cylinder 313*a* opposite to the window 313*f*; and push levers 313*i* each pivoted to the side of the frame of the auxiliary mat member 310 and biased by means of a torsion spring 313*j* in such manner that the end of the push lever 313*i* is positioned above the top of the shift rod 313*b*. Accordingly, when the lever 313*i* pushes the top of the shift rod 313*b* against the bias of the spring 313*j*, the rod 313*b* is shifted down thereby to cause the engaging top 313*3* being away from the inner surface of the frame 314 and then the frictional engagement of the engaging piece 313*d* to the frame 314 is left, whereby the cylinder 313*a* upwardly is shifted by the bias of the spring 315. When the cylinder 313*a*, i.e., the mat member 310 is shifted to a prescribed position, the operating force to push lever should be removed. Consequently, the mat member 310 is settled by the engaging piece 313*d* being again engaged to the inner periphery of the frame 314.

In order to shift down the cylinder 313*a*, the push lever is also pushed and under its condition, the cylinder 313*a* is forcedly shifted downwards against the bias of the spring 315.

In connection with the attachment of this invention as illustrated in FIGS. 14 to 18, our inventors further insist to include a modification, as described hereinafter but not shown, in the technical scope of this invention.

Such modification comprises a planger pump assembly adapted to be operated as that of the planger pump 151 already mentioned. Specially, the planger pump assembly includes a planger piston adapted to be directly pushed by the motion of the dynamic therapy member 71 of the multi-therapeutic device when the dynamic therapy member 71 is upwardly moved by the spring bias of the means 100. In this case, the planger pump piston is downwardly biased by means of spring so as to maintain a contact condition to the top of the dynamic therapy member 71.

Accordingly, the attachment of this modification is improved in a simple construction, because the attachment has no interlocking means and improved specially to act as such a duplicate operation that immediately after the keading heads push the human body in a manner to put him between the keading heads and before the spool valve is released, the planger pump piston is stopped by the exchange of the revolution direction of the motor included in the multi therapeutic device thereby to maintain the pushing of the keading heads to the human body, and simultaneously the installing base member is vibrated by the vibration means due to the exchange of the motor-revolution direction, thereby to apply the vibration to the heading head.

What is claimed is:

1. A multi therapeutic device for use in dynamic therapy characterized by comprising a reversible motor having an output shaft capable of being changed in two opposite revolving directions thereof; first and second one-way clutch means operable to the opposite revolving directions respectively so as to be alternatively connected with the output shaft; first and second eccentric rotor means driven by the motor power given via their one-way clutch means respectively; means for vibration driven by the first eccentric rotor means; means for taking out an orbital motion from the motion of the second eccentric rotor means; means for vertical dynamic motion including one or more reciprocating members with one or more dynamic therapy members; and means for changing the orbital motion to a suitable motion for use of and transmitting the motion to the vertical dynamic motion means.

2. A multi therapeutic device for use in dynamic therapy claimed in claim 1 in which the vertical dynamic motion means further includes bias means to which the power is changed by one-direction movement of the reciprocating member, and means for discharging the biassed power for a time so as to move the reciprocating member in an opposite direction.

3. A multi therapeutic device for use in dyanamic therapy claimed in claim 2 in which there is provided means for releasing the bias means from the reciprocating motion of the reciprocating member.

4. A multi therapeutic device for use in dynamic therapy claimed in claim 2 in which there is provided means for adjusting the power which is charged to the bias means.

5. A multi therapeutic device for use in dynamic therapy claimed in claim 2 in which there is provided means concurrently used for releasing the bias means from the reciprocating motion of the reciprocating member, and for adjusting the power which is charged to the bias means.

6. A multi therapeutic device for use in dynamic therapy claimed in claim 1 in which the vertical dynamic motion means further includes one or more turnable cylindrical cams each having a sprial surface with one or more stepped portions for quick motion, and one or more cam follows connected with the reciprocating members respectively so as to be guided by the spiral surface.

7. A multi therapeutic device for use in dynamic therapy claimed in claim 1 in which the motion changing means comprises one or more crank motion elements driven by the orbital motion, one or more turning elements reciprocatingly driven by the crank elements, and third one-way clutch means for transmitting one-direction turning component of the reciprocation of the turning element to the corresponding vertical dynamic motion means.

8. A multi therapeutic device for use in dynamic therapy claimed in claim 1 in which the motion changing means comprises a crank motion element with a pivot supporter driven by the orbital motion, one or more link elements, one or more turning elements reciprocating driven by the crank elements via the link elements, and third one-way clutch means for transmitting one-direction turning component of the reciprocation of the turning element to the corresponding vertical dynamic motion means.

9. A multi therapeutic device for use in dynamic therapy claimed in claim 1 in which the motion changing means comprises a crank motion element driven by the orbital motion, two or more turning elements at least one of which is reciprocatingly driven by the crank motion element directly and the other of which is/are reciprocatingly driven by the crank element via one or more elements and third one-way clutch means for transmitting one-direction turning component of the reciprocation of each of the turning elements to the corresponding vertical dynamic motion means.

10. A multi therapeutic device for use in dynamic therapy claimed in claim 1 in which the motion changing means comprises a square motion means having a square element driven by the orbital motion so as to be moved in two directions mutually defined at a right angle, a transmission member adapted to support the square element slidably to one of the two directions and capable of being moved to the other of the two directions, one or more turning elements reciprocatingly driven by the movement of the transmission member, and third one-way clutch means for transmitting one-direction component of the reciprocation of the turning element to the corresponding vertical dynamic motion means.

11. A multi therapeutic device for use in dynamic therapy claimed in claim 10 in which the motion changing means includes one or more slide pieces slidably supported to the transmission member and pivoted to the corresponding turning elements.

12. A multi therapeutic device for use in dynamic therapy claimed in claim 10 in which the motion changing means includes one or more link elements pivoted to the transmission member and the corresponding turning elements respectively.

13. A multi therapeutic device for use in dynamic therapy claimed in claim 1 in which there are provided a therapeutic head member having a flexible touching sheet to the back of which the dynamic therapy members are capable of being depressed; an installing base member to which the therapeutic head member is attached and which includes means to rotatably bear a suitable part included in the vibration means; and flexible supporters by which the base member is supported to a housing included in the therapeutic device.

14. A multi therapeutic device for use in dynamic therapy claimed in claim 1 in which there are provided a therapeutic head member having at least one swingable means with a kneading head, bias means for kneading operation, means for regulating the swingable means via the bias means in such a manner that control power is supplied from the dynamic therapy member and transmitted to the regulating means; and installing base member to which the therapeutic head member is attached and which is supported to a housing included in the therapeutic device.

15. A multi therapeutic device for use in dynamic therapy claimed in claim 14 in which the bias means consists of an oil control system which includes a spool valve with a spool member, an actuator for driving the swingable means, and a toggle means adapted to act the spool member in such a manner that the pressure oil of the actuator is released when the oil pressure applied to the spool valve overs the prescribed degree defined by the toggle bias of the toggle means, and the returning motion of the swingable means causes the spool member and the toggle means being reset on.

16. A combination with a multi therapeutic device and a folding bed, said multi therapeutic device comprising areversible motor having an output shaft capable of being changed in two opposite revolving directions thereof; first and second one-way clutch means operable to the opposite revolving directions respectively so as to be alternatively connected with the output shaft; first and second eccentric rotor means driven by the motor power given via their one-way clutch means respectively; means for vibration driven by the first eccentric rotor means; means for taking out an orbital motion from the motion of the second eccentric rotor means; means for vertical dynamic motion including one or more reciprocating members with one or more dynamic therapy members; and means for changing the orbital motion to a suitable motion for use of and transmitting the motion to the vertical dynamic motion means, and said folding bed comprising a bed frame; means for guiding the multi therapeutic device along a guide mounted on the bed frame; a pair of means for supporting a human body each having a supportor; bias means for causing the supporting means to be mutually access to each other; and means for carrying the multi therapeutic device in its travelling area defined by the guide; said supporting means having a travelling area separately defined in the travelling area of the multi therapeutic device whereby the multi therapeutic device as travel brings either one of the supporting means with itself.

17. A combination with a multi therapeutic device and a folding bed, said multi therapeutic device comprising a reversible motor having an output shaft capable of being changed in two opposite revolving directions thereof; first and second one-way clutch means operable to the opposite revolving directions respectively so as to be alternatively connected with the output shaft; first and second eccentric rotor means driven by the motor power given via their one-way clutch means respectively; means for vibration driven by the first eccentric rotor means; means for taking out an orbital motion from the motion of the second eccentric rotor means; means for vertical dynamic motion including one or more reciprocating members with one or more dynamic therapy members; and means for changing the orbital motion to a suitable motion for use of and transmitting the motion to the vertical dynamic motion means, and said folding bed comprising two bed frames with seat mats, the bed frames being pivoted to each other; means for holding the multi therapeutic device disposed in the interior of one of the bed frames; means for supporting the frames in a suitable spread condition, the supporting means being disposed in the other of the frames; and an auxiliary mat member shiftably mounted on the latter bed frame.

* * * * *